US011594825B2

(12) United States Patent
Txarola et al.

(10) Patent No.: US 11,594,825 B2
(45) Date of Patent: Feb. 28, 2023

(54) IDCC CONNECTION SYSTEM AND PROCESS

(71) Applicant: J.S.T. CORPORATION, Farmington Hills, MI (US)

(72) Inventors: Joseph Txarola, Farmington Hills, MI (US); Gwendolyn Upson, Ypsilanti, MI (US); Ping Chen, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 17/173,633

(22) Filed: Feb. 11, 2021

(65) Prior Publication Data

US 2021/0175642 A1 Jun. 10, 2021

Related U.S. Application Data

(62) Division of application No. 16/174,825, filed on Oct. 30, 2018.

(Continued)

(51) Int. Cl.
*H01R 4/2429* (2018.01)
*H01R 12/51* (2011.01)

(Continued)

(52) U.S. Cl.
CPC ..... *H01R 4/2429* (2013.01); *H01R 9/2416* (2013.01); *H01R 12/515* (2013.01);

(Continued)

(58) Field of Classification Search
CPC .... H01R 12/585; H01R 13/05; H01R 4/2429; H01R 12/515; H01R 12/58;

(Continued)

(56) References Cited

U.S. PATENT DOCUMENTS 6,007,366 A * 12/1999 Torii ..... H01R 43/0256 439/397
6,050,842 A * 4/2000 Ferrill ..... H01R 13/6461 439/404
6,050,845 A * 4/2000 Smalley, Jr. ..... H01R 12/515 439/417

(Continued)

*Primary Examiner* — Briggitte R. Hammond
(74) *Attorney, Agent, or Firm* — Kratz, Quintos & Hanson, LLP

(57) ABSTRACT

An Insulation Displacement Contact Compliant connector system (IDCC) which includes a housing, header pins, and a Printed Circuit Board (PCB). Each header pin has at least a single barb to be retained into the housing. Each pin has a blade for contacting a wire. A compliant feature on the pin retains itself into holes in the PCB. The housing has a negative space similarly shaped to the pin. The housing includes a strain relief which provides a lead-in for a wire. When the system is fully assembled, the pins reside in the housing, and exit through the housing and into and through respective holes in the PCB. A wire can be inserted into the housing once the pins reside in the housing. There are several options for the assembly process including a) a pin-to-housing insertion process; b) a housing assembly-to-PCB process or a connector-to-PCB process; and c) a wired housing assembly-to-PCB assembly process or a wire harness-to-PCB assembly process.

4 Claims, 29 Drawing Sheets

Related U.S. Application Data

(60) Provisional application No. 62/579,325, filed on Oct. 31, 2017.

(51) Int. Cl.

| | |
|---|---|
| ***H01R 43/20*** | (2006.01) |
| ***H01R 43/01*** | (2006.01) |
| ***H01R 12/58*** | (2011.01) |
| ***H01R 9/24*** | (2006.01) |
| ***H01R 13/40*** | (2006.01) |
| ***H01R 12/71*** | (2011.01) |

(52) U.S. Cl.
CPC ..... *H01R 12/585* (2013.01); *H01R 13/40* (2013.01); *H01R 43/01* (2013.01); *H01R 43/205* (2013.01); *H01R 12/712* (2013.01)

(58) Field of Classification Search
CPC ..... H01R 12/7064; H01R 4/00; H01R 4/24; H01R 4/2404; H01R 4/2445; H01R 4/2495; H01R 9/031; H01R 9/053; H01R 12/616; H01R 12/67; H01R 12/675
See application file for complete search history.

(56) References Cited

U.S. PATENT DOCUMENTS

| | | | | |
|---|---|---|---|---|
| 6,093,048 | A * | 7/2000 | Arnett | H01R 12/58 439/82 |
| 6,168,478 | B1 * | 1/2001 | Daoud | H01R 4/2429 439/854 |
| 7,070,442 | B2 * | 7/2006 | Yamanashi | H01R 4/2433 439/417 |
| 7,736,173 | B2 * | 6/2010 | Chen | H01R 13/41 439/404 |
| 7,976,334 | B2 * | 7/2011 | Bishop | H01R 4/2433 439/404 |
| 8,708,733 | B2 * | 4/2014 | Parrish | H01R 4/242 439/395 |
| 9,083,091 | B1 * | 7/2015 | Ravlich | H01R 4/2425 |
| 2018/0287277 | A1 * | 10/2018 | Lybrand | H01R 12/515 |

* cited by examiner

IDCC CONNECTION SYSTEM AND PROCESS

CROSS-REFERENCE TO RELATED APPLICATIONS

This application is a Divisional of U.S. patent application Ser. No. 16/174,825, filed Oct. 30, 2018, which claims priority of U.S. provisional application No. 62/579,235, filed Oct. 31, 2017.

FIELD OF THE INVENTION

The present invention generally relates to the field of electrical connectors, which are useful in automotive applications, or the like.

DESCRIPTION OF THE RELATED ART

An insulation-displacement contact (IDC) is an electrical contact designed to be connected to the conductor(s) of an insulated cable by a connection process that forces a selectively sharpened blade or blades through the insulation, bypassing the need to strip the conductors of insulation before connecting. A compliant pin is a pin that adheres to a PCB through the application of normal force and interference fit. Insulation Displacement Contact Compliant header pins (IDCC header pins) are used in connector systems. In use, during an insertion process, the header pin is placed into a housing and secured, allowing the housing to then be attached to a circuit board using a compliant end, with no solder, and have wires (conductors) inserted into the blades thereof. In many examples of the related art, when IDCC pins are inserted into a housing, the securing of the header pins requires an additional component, such as a plastic cover or pronged terminal system.

BRIEF SUMMARY OF THE INVENTION

An Insulation Displacement Contact Compliant connector system (IDCC) and process for using an IDCC connection system. The IDCC connection system includes IDCC header pins and a housing. The system and the process may include a printed circuit board (PCB). Each IDCC header pin is comprised of an upper section, a pin barb section, and a lower section. Each IDCC header pin has at least a first pin barb on its pin barb section, to allow it to be retained into the housing. The pin barbs anchor the header pin into the housing. The upper section of each IDCC header pin also has a blade to contact a wire and displace the insulation thereof. The lower section of the pins has an associated compliant retention feature which allows the IDCC header pin to be retained into respective holes in the PCB.

The housing has a negative space similarly shaped to side walls of the IDCC header pin. The housing may include a strain relief which provides a lead-in a wire. When the system is fully assembled, the pins reside in the housing, and exit through the housing and into and through respective holes in the PCB. A wire can be inserted into the housing and pass the strain relief lead-in, and the wire is then secure. The wire then contacts the blade of the pins in the housing. Further embodiments of the housing can also have a twisting strain relief, as well as retention posts that allow the housing to be secured to the PCB. There are several options for the assembly process including a) a pin-to-housing insertion process; b) a housing assembly-to-PCB process or a connector-to-PCB process; and c) a wired housing assembly-to-PCB assembly process or a wire harness-to-PCB assembly process.

BRIEF DESCRIPTION OF THE SEVERAL VIEWS OF DRAWINGS

FIGS. 8A-E are cross-sectional views of steps of an inventive process of assembling the IDCC header pin to a housing.

Figure 11A:
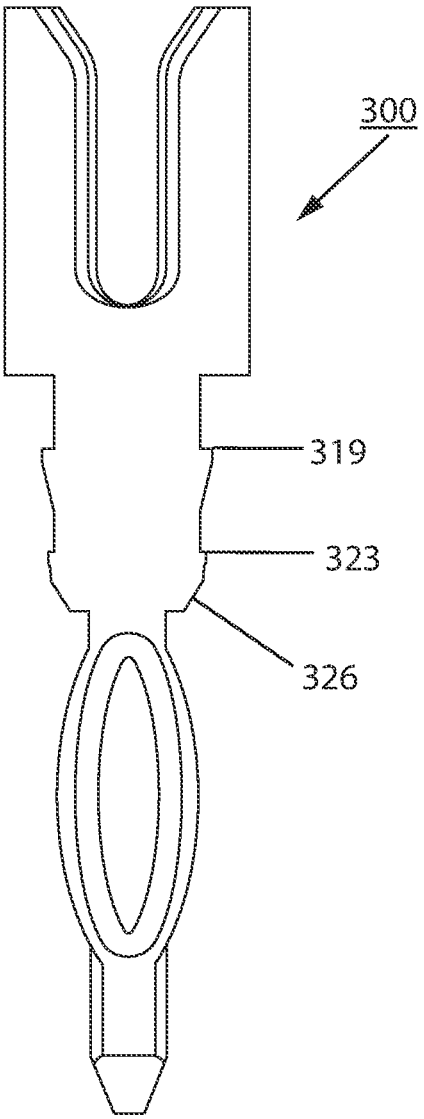
Figure 11B:
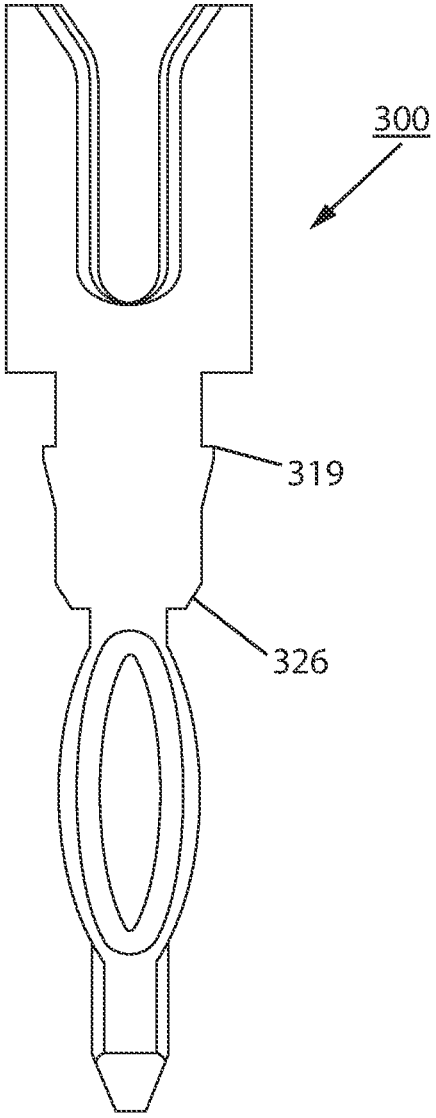
Figure 11C:
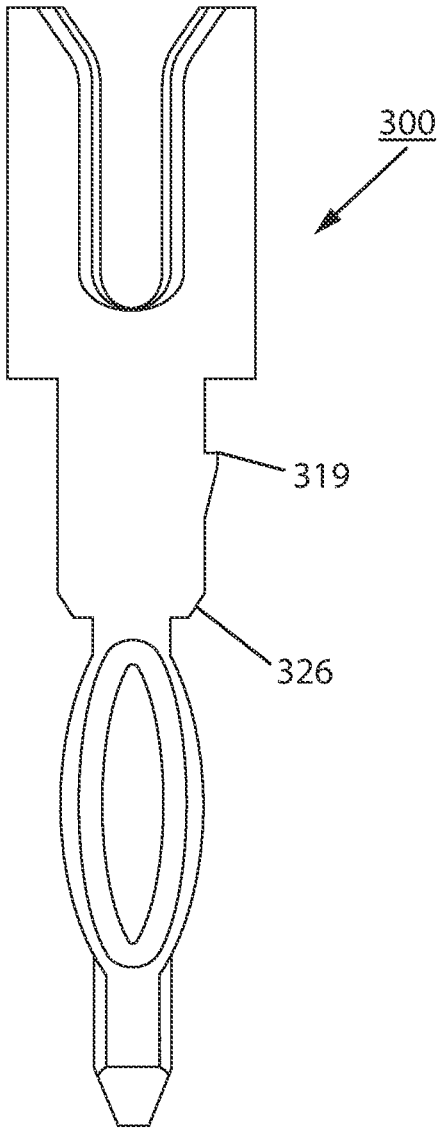

FIGS. 9A-D are cross-sectional views of steps of an inventive process of assembling the housing to a printed circuit board;

FIGS. 10A-D are cross-sectional views illustrating steps of assembling a wire to the system of the invention;

FIGS. 11A, B, C, D, E, F, and G are front elevation views of another embodiments of an IDCC header pin.

Figure 12:
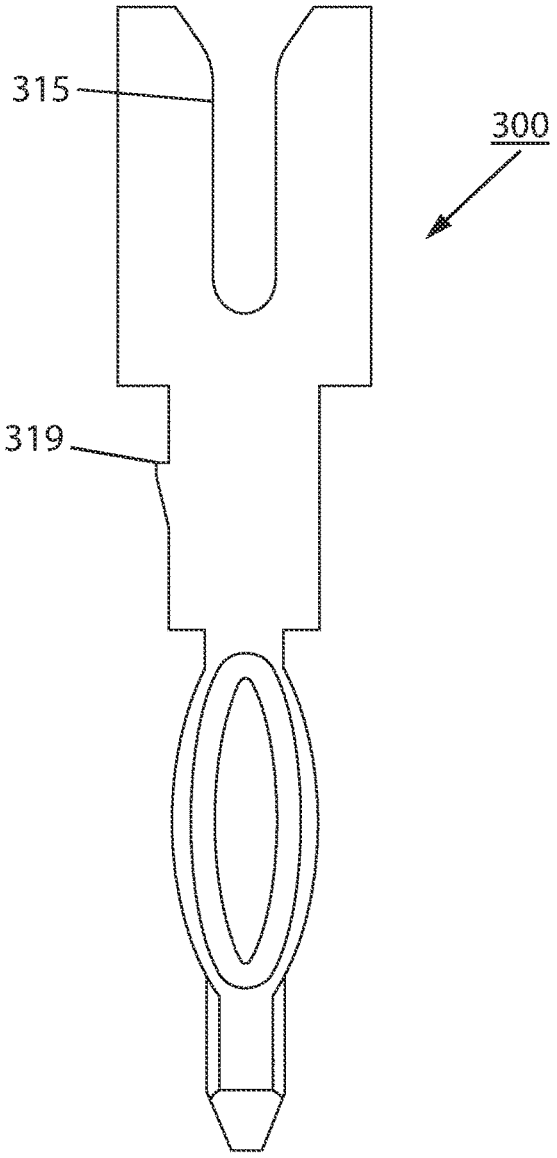

FIG. 12 is a front elevation view of another embodiment of an IDCC header pin.

DETAILED DESCRIPTION OF THE INVENTION

The present invention provides an IDCC connection system and process for using an IDCC connection system.

Figure 1:
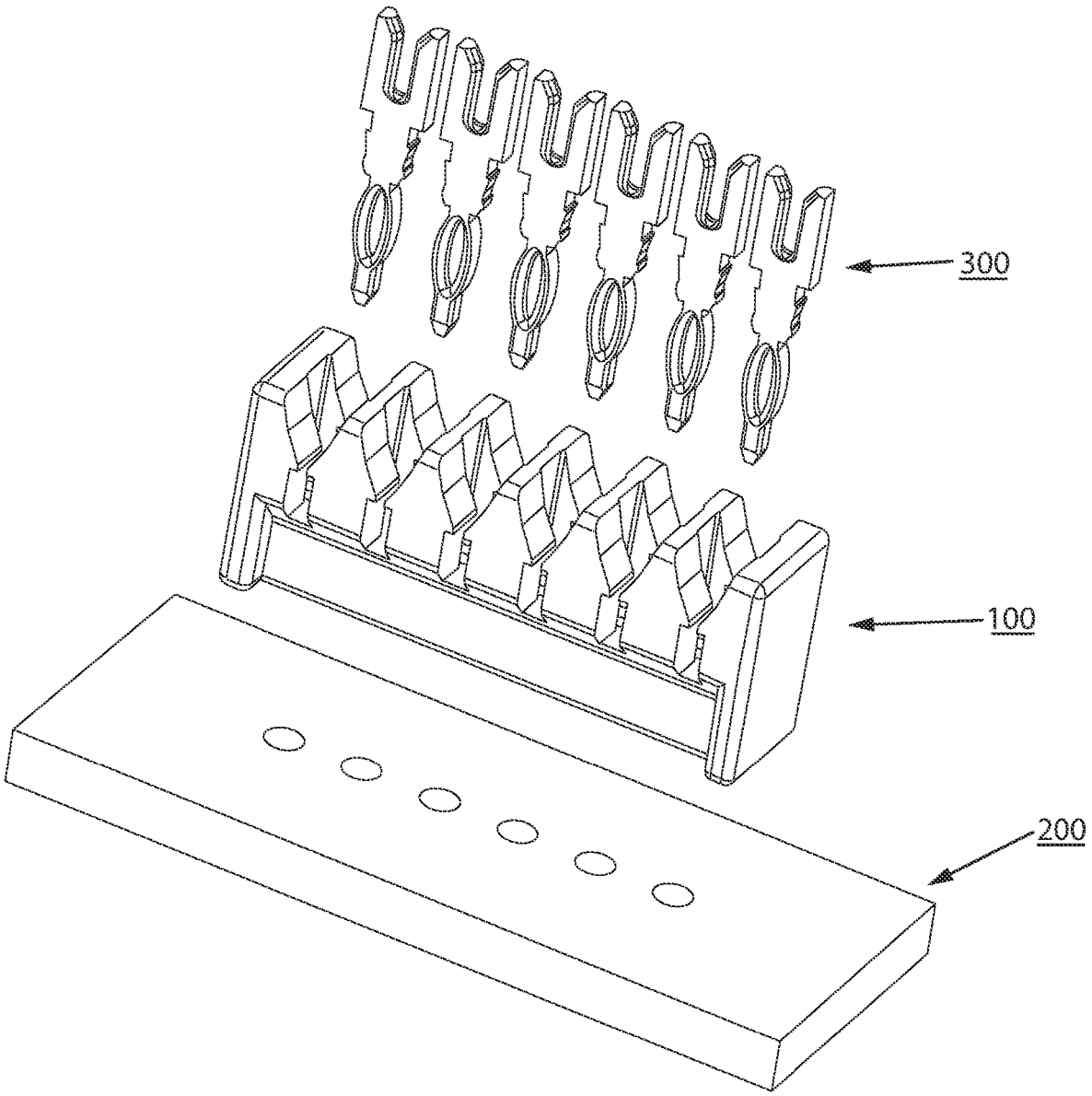
FIG. 1 is an exploded perspective view of one embodiment of the IDCC connection system of the present invention before assembly, including an IDCC header pin, a housing and a printed circuit hoard.
Figure 2:
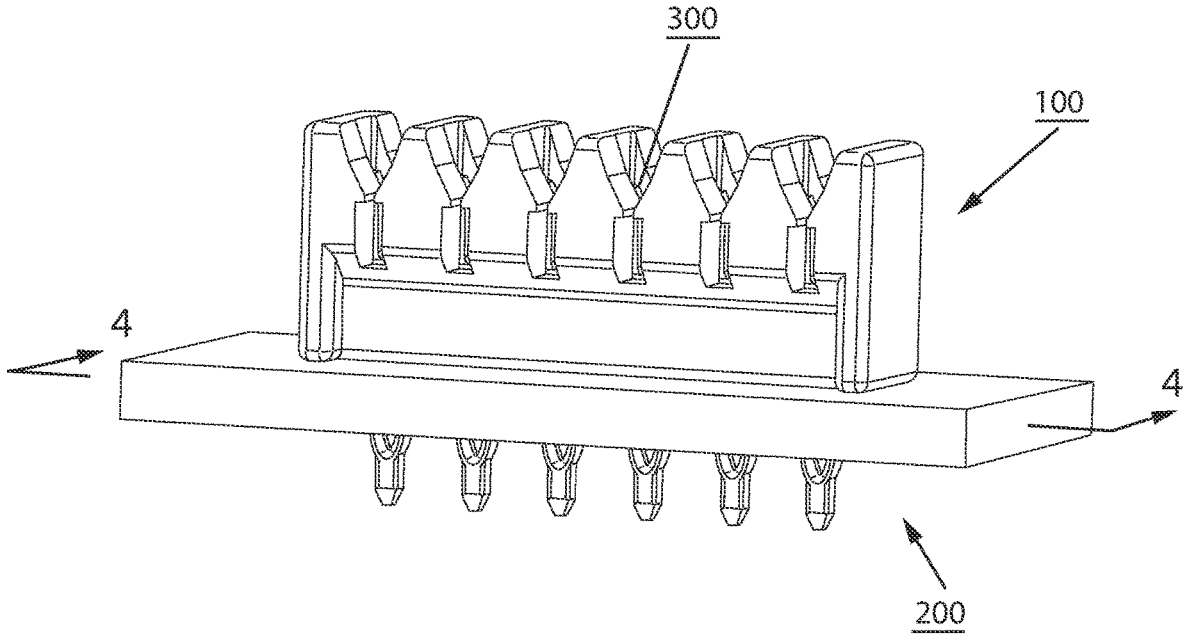
FIG. 2 is a perspective view of one embodiment of the IDCC connection system of the present invention after assembly, including an IDCC header pin, a housing, and a printed circuit board.

As shown in FIG. 1, the IDCC connection system includes IDCC header pins 300, a housing 100 and a printed circuit board (PCB) 200. When fully assembled, as shown in FIG. 2, IDCC header pins 300 reside in housing 100 and are inserted through printed circuit board 200.

Figure 3:
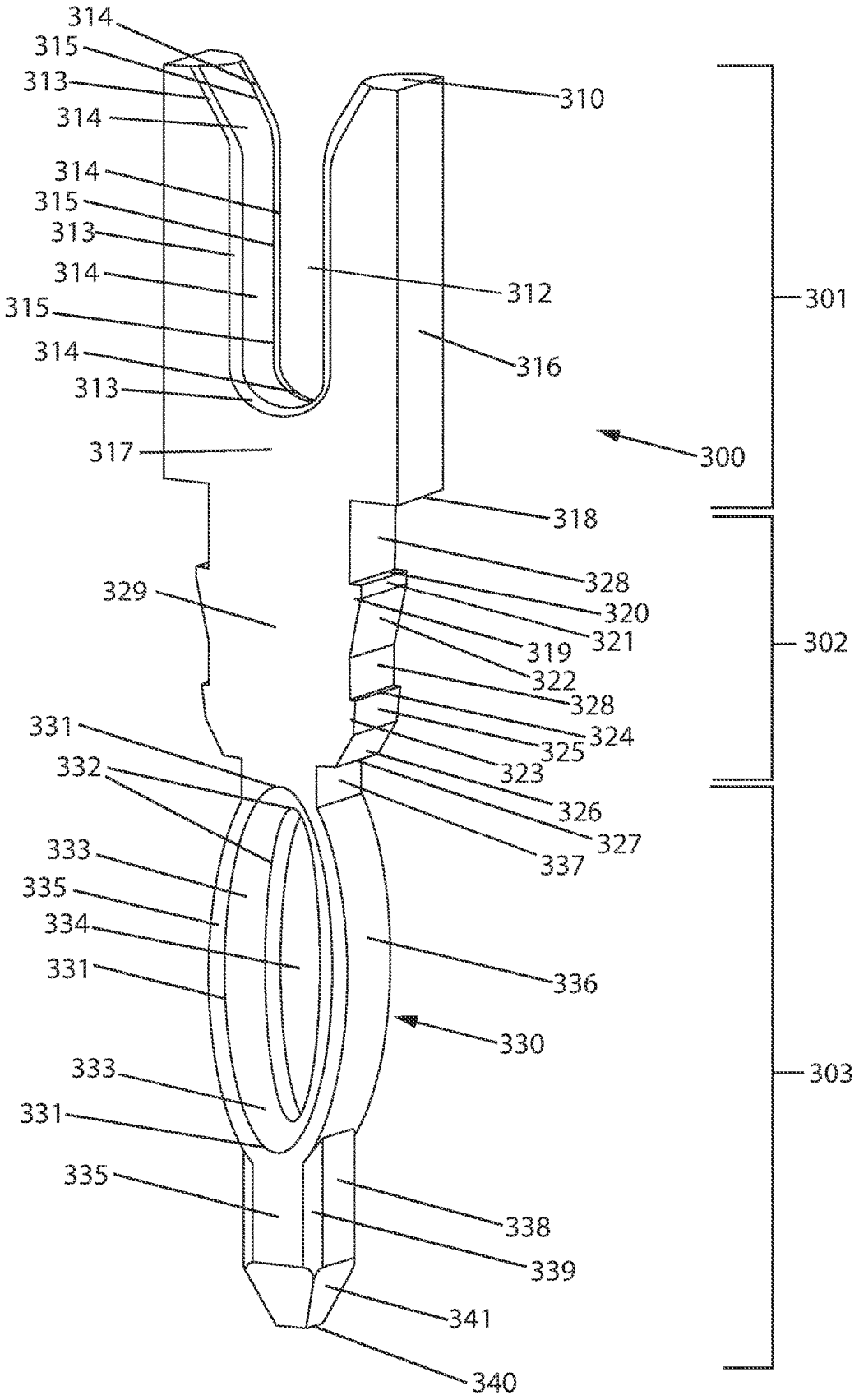
FIG. 3 is a perspective view of one embodiment of the IDCC header pin of he present invention.

FIG. 3 illustrates the IDCC header pin 300 in more detail. As shown in FIG. 3, the IDCC header pin 300 can be considered to have a lengthwise direction and can be considered to have three sections: an upper section 301, a pin barb section 302 and a lower section 303.

In upper section 301, at one end, in the lengthwise direction of the IDCC header pin 300 is IDC flat 310, which includes two flat regions perpendicular to the lengthwise direction of IDCC header pin 300. The IDCC flat 310 is a surface on which a machine/jig can apply force to the IDCC header pin 300 to insert it into housing 100. Along the side of the lengthwise direction of the upper section 301 are side walls 316. At the opposite end of the IDCC header pin 300 in the lengthwise direction, is IDCC header pin tip 340. The lower section 303 includes pin lead-in chamfers 341, which are angled to prevent stubbing of the header pin 300 when it is inserted into and through the housing or a hole in a printed circuit board.

In upper section 301, below the flat 310 in FIG. 3 is IDCC blade 315. IDC blades are known in the art and are capable of cutting into the wire jacket of a wire conductor to make non-damaging electrical contact with a wire conductor. IDCC blade 315 is generally of a horseshoe shape with a gap 312 between the blade 315. The upper section 301 additionally has a first surface 313 and a second surface 314 which form a beveled surface from the face 317 of the upper section 301 to the IDCC blade 315. Further, in the IDCC header pin embodiment in FIG. 12 the first surface 313 and second surface 314 are optionally omitted from the upper section 301 structure.

Figure 4:
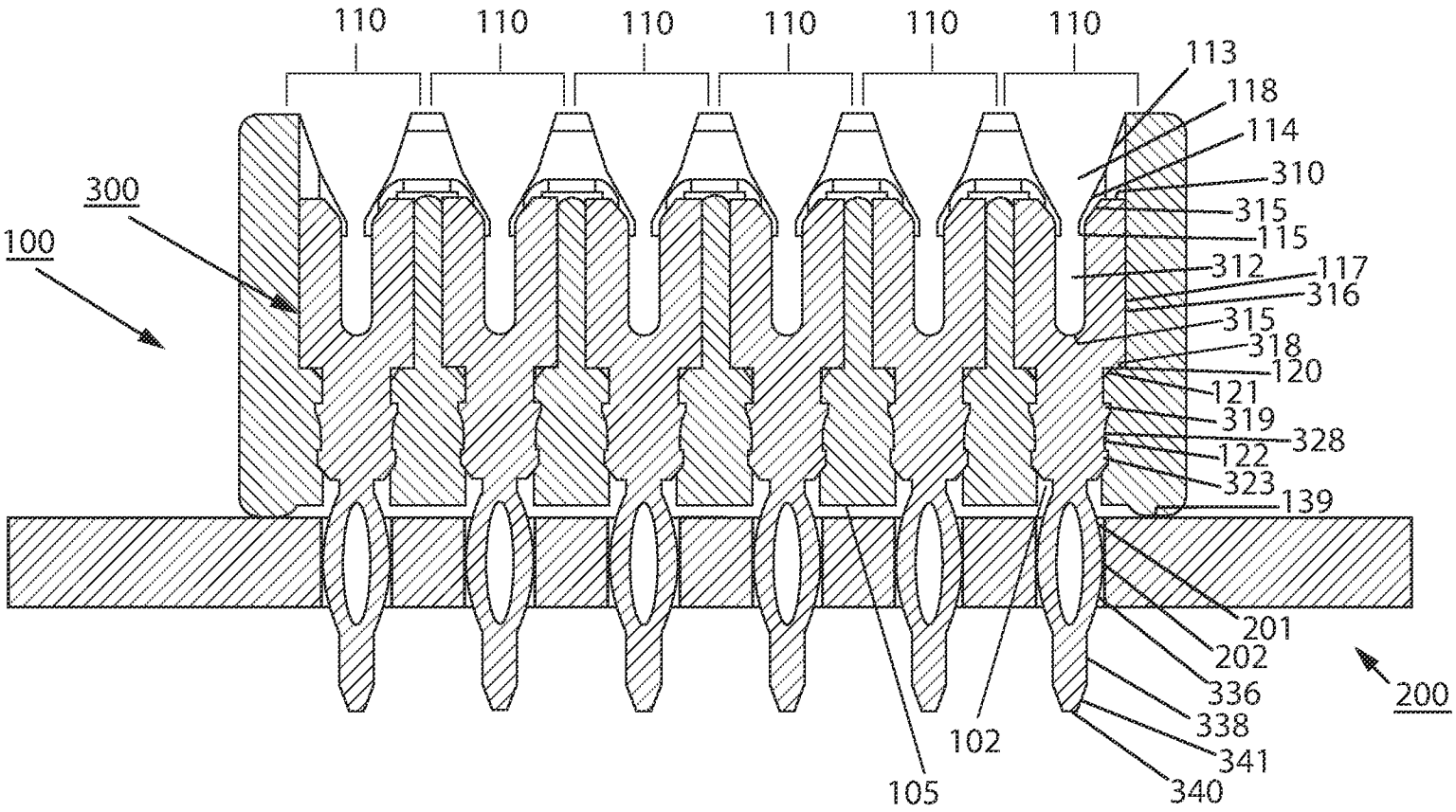
FIG. 4 is a front elevation cross-sectional view of an embodiment of the assembled IDCC connection system, showing the relationship between the IDCC header pin, the housing, and the printed circuit hoard.

Below the IDCC blade 315 in FIG. 3 (i.e., in the direction toward tip 340), in the lower portion of upper section 301, is forward stop 318, which includes two opposite flat regions perpendicular to the lengthwise direction of the IDCC header pin 300 and facing generally toward tip 340. This forward stop 318 functions to end forward motion of the IDCC header pin 300 when inserted into the housing 100, and defines the position of the IDCC header pin 300 when fully inserted in the housing 100 (see FIG. 4).

Below the forward stop 318 is pin barb section 302. Pin barb section 302 includes a face surface 329 and sides 328. The sides 328 have at least a first pin barb 319. Pin barbs are known in the art and function to anchor and retain the IDCC header pin 300 when inserted into a housing, preventing it from being withdrawn (see FIG. 4). First pin barb 319, is an angled protrusion which extends outward from side 328 and has a top surface 320 perpendicular to the lengthwise direction of the pin 300. The first pin barb 319 further includes a side wall 321 which is generally parallel to the lengthwise direction of the pin 300 and an outward angled side wall 322 leading up to the lower end of side wall 321. In FIG. 3, first pin barb 319 is present on opposite sides 328 of pin barb section 302 respectively. In FIG. 3, below the first pin barb 319 is second pin barb 323, also an angled protrusion which extends outward from side 328 and has a top surface 324 perpendicular to the lengthwise direction of the pin 300. The second pin barb 323 further includes a side wall 325 which is generally parallel to the lengthwise direction of the pin 300 and extends from an upper end of an angled barb lead-in chamfer 326 at the bottom of pin barb section 302. In FIG. 3, second pin barb 323 is present on opposite sides 328 of pin barb section 302 respectively. Second pin barb 323 also serves to anchor and retain the IDCC header pin 300 when inserted into the housing 100 (see FIG. 4). It is possible for the IDCC header pin to have only a single first pin barb (see FIG. 12) and any additional pin barbs (see FIG. 11A-E), but generally a pair of first and second pin barbs on opposite sides of the pin barb section 302 will be present (see FIGS. 3, 11A) to provide a sufficient anchoring into the housing 100.

At the lower end of pin barb section 302, is the barb lead-in chamfer 326, which is an angled wall, angled upward from a bottom surface 327 of pin barb section 302 which is perpendicular to the lengthwise direction of the IDCC header pin 300. The barb lead-in chamfer 326 serves to lead the pin barb section 302 of the IDCC header pin 300 into the housing 100 and thereby prevent stubbing of the IDCC header pin 300 during insertion into the housing. Further, in the embodiment in FIGS. 11D and 12 the barb lead-in chamfer is optionally omitted from the pin structure (see FIG. 11D, 12).

As further illustrated in FIG. 3, below the barb lead-in chamfer 326, in lower section 303, is compliant retention feature 330, in an eye-of-the-needle design. The compliant retention feature 330 includes oval rounded sides 336 and an inner beveled wall 333 which forms an oval shaped inner hole 334. The oval rounded sides 336 extend outward from sides 337, 338, and 339 of lower section 303. In the center of the compliant retention feature 330 is an oval shaped inner hole 334. The inner hole 334 is formed by an inner beveled wall :333 which angles inward from the face 335 of the lower section 303. The surface of the beveled side wall extends from an outer edge 331 to an inner edge 332. The inner edge 332 forms a perimeter around the inner hole 334 in the middle of the compliant retention feature 330. The compliant retention feature flexes inward when pressure is applied to the oval rounded sides 336. Compliant retention feature 330 of the IDCC header pin penetrates a respective hole 201 in the PCB 200 when the IDCC connection system is assembled. The oval rounded sides 336 are compressed and flex inward by the inside edge 202 of the hole 201 when inserted into the PCB 200, thereby the oval rounded sides 336 provide pressure outward against the inside edges 202 of the hole 200.

Figure 11D:
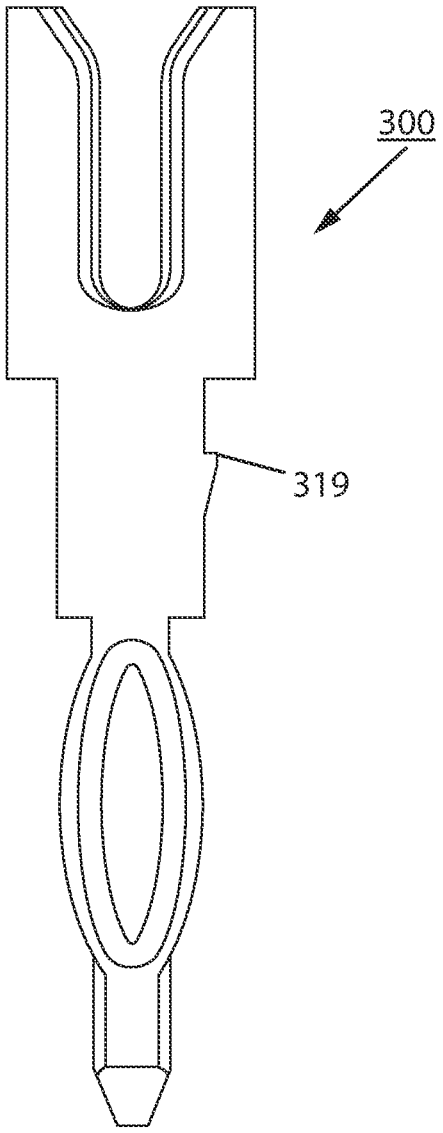
Figure 11E:
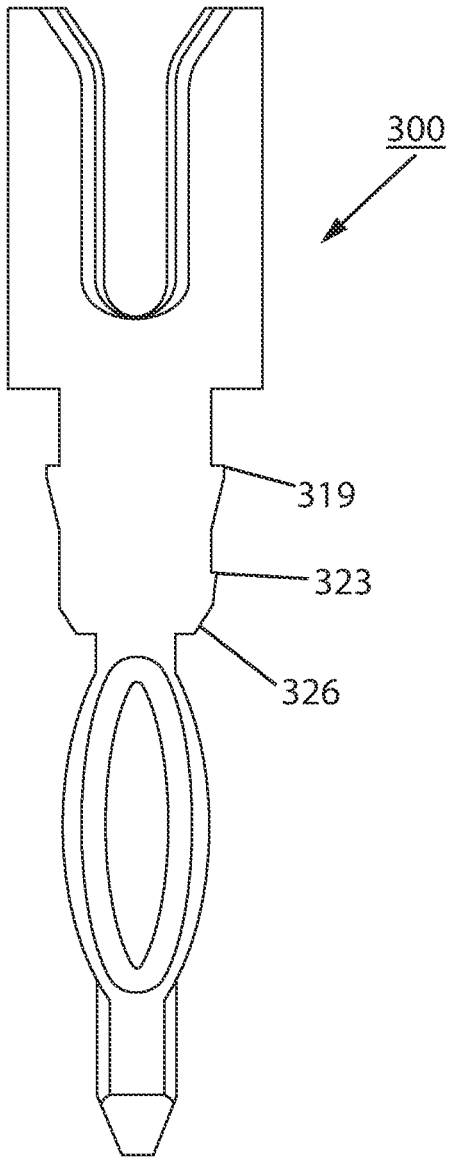
Figure 11F:
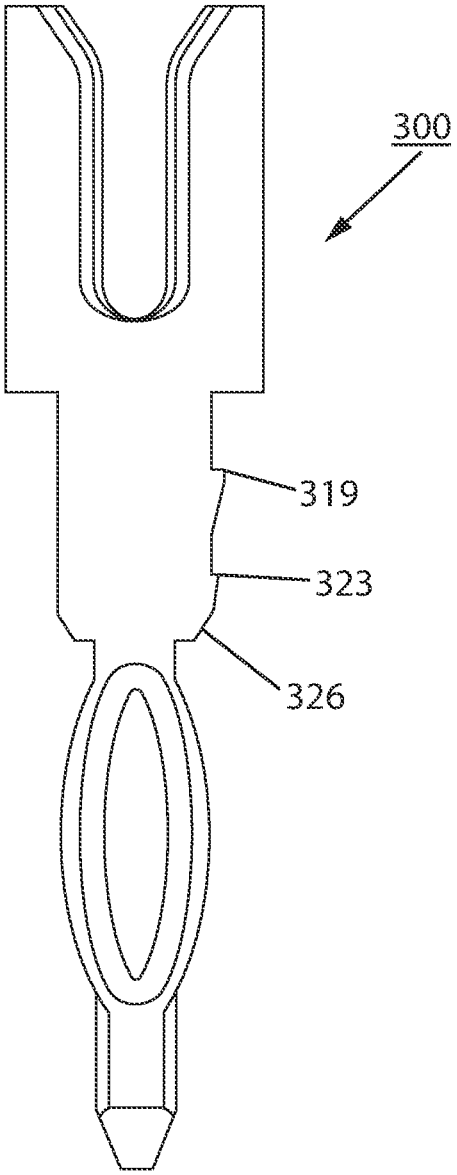
Figure 11G:
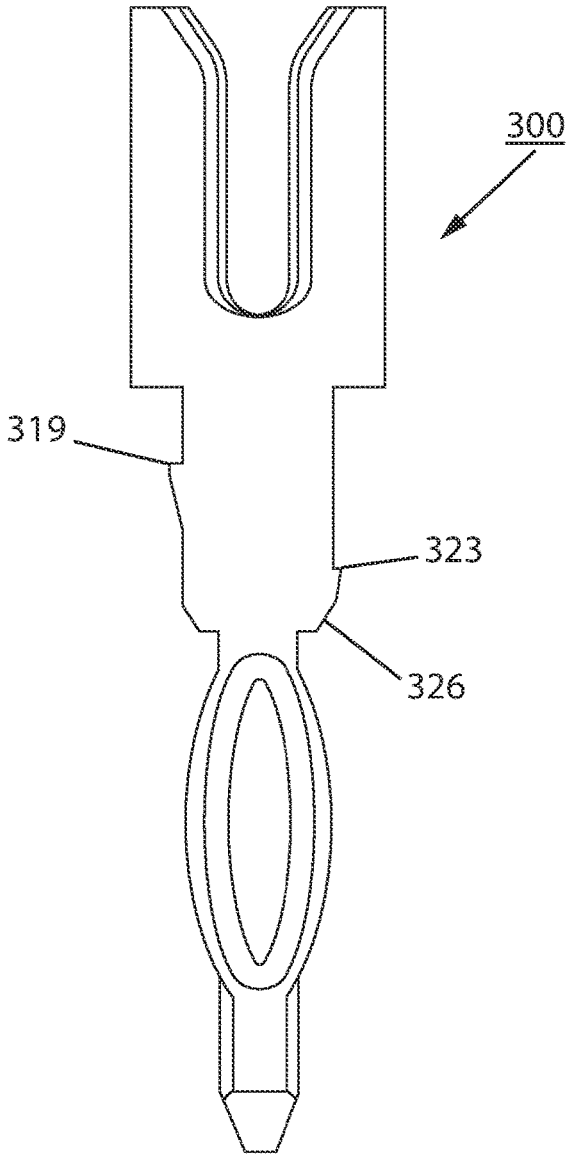

Shown FIGS. 11A-G are embodiments of IDCC header pin 300, wherein the pin 300 has at least one of a first pin barb and an arrangement of additional first and second pin barbs as shown. In FIGS. 11D, 12 the pin barb section chamfer is removed. These embodiments are not limited to the combinations shown but allow for a combination of these features.

Figure 5A:
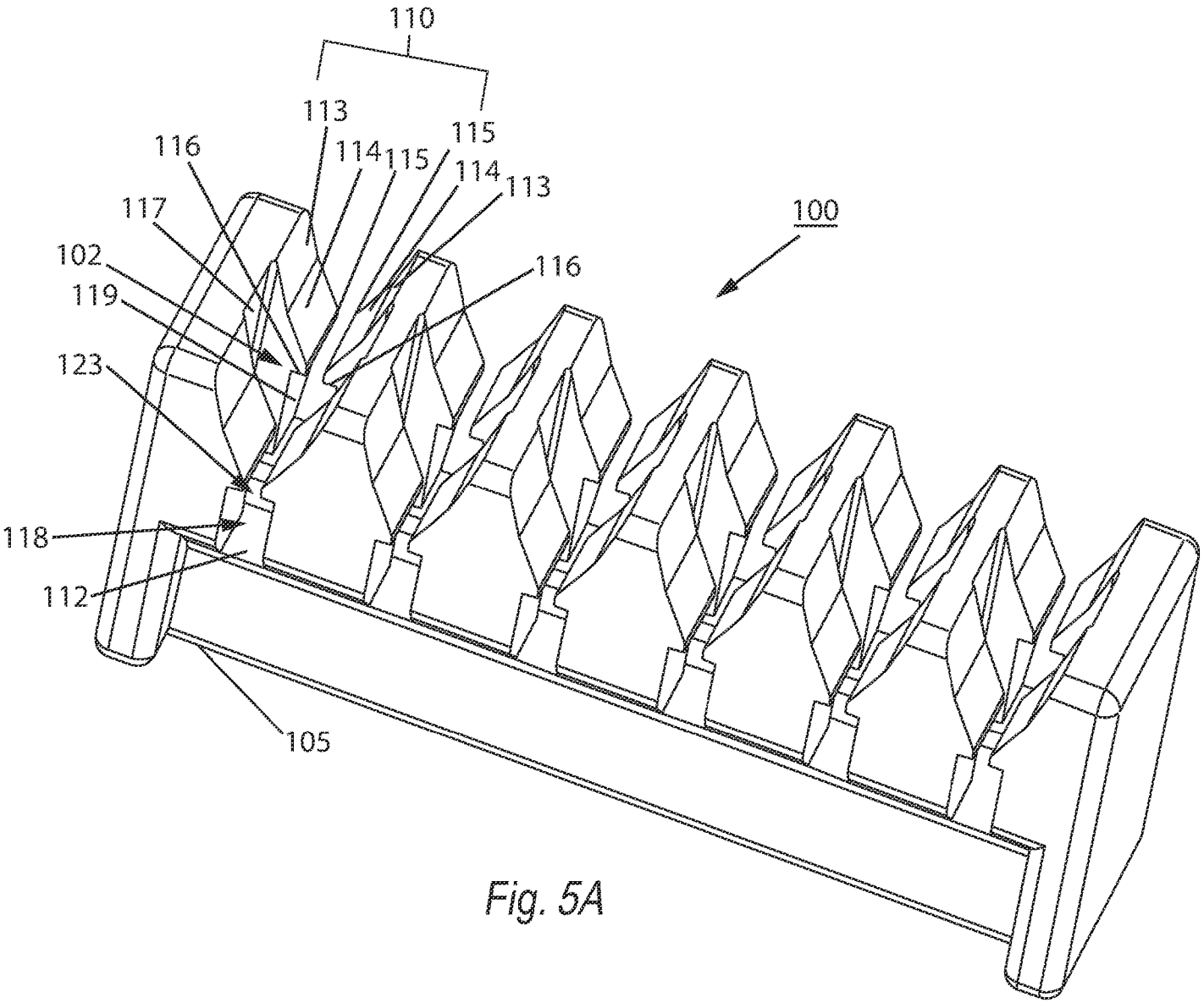
FIG. 5A is a perspective view of one embodiment of the housing of the invention.
Figure 5B:
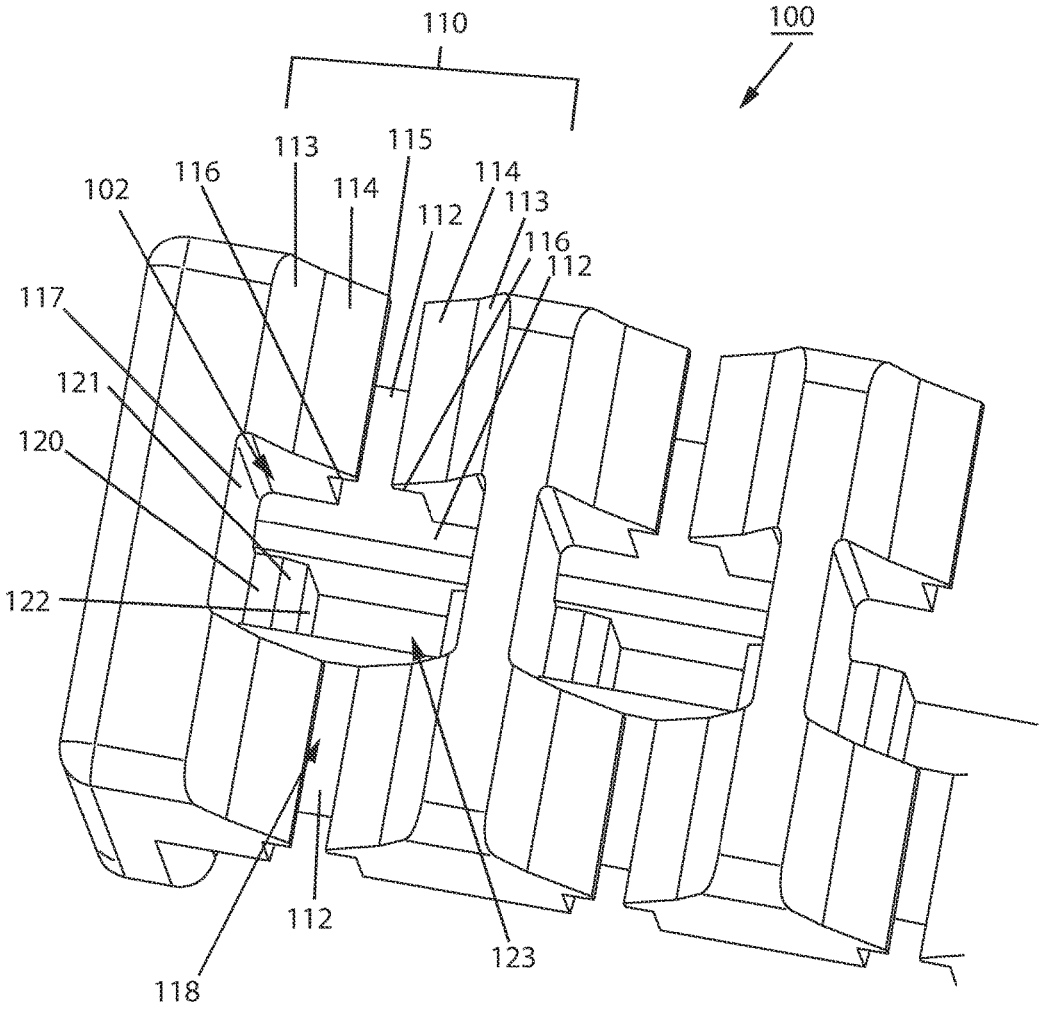
FIG. 5B is a perspective view of a portion of one embodiment of the housing of the invention.
Figure 5C:
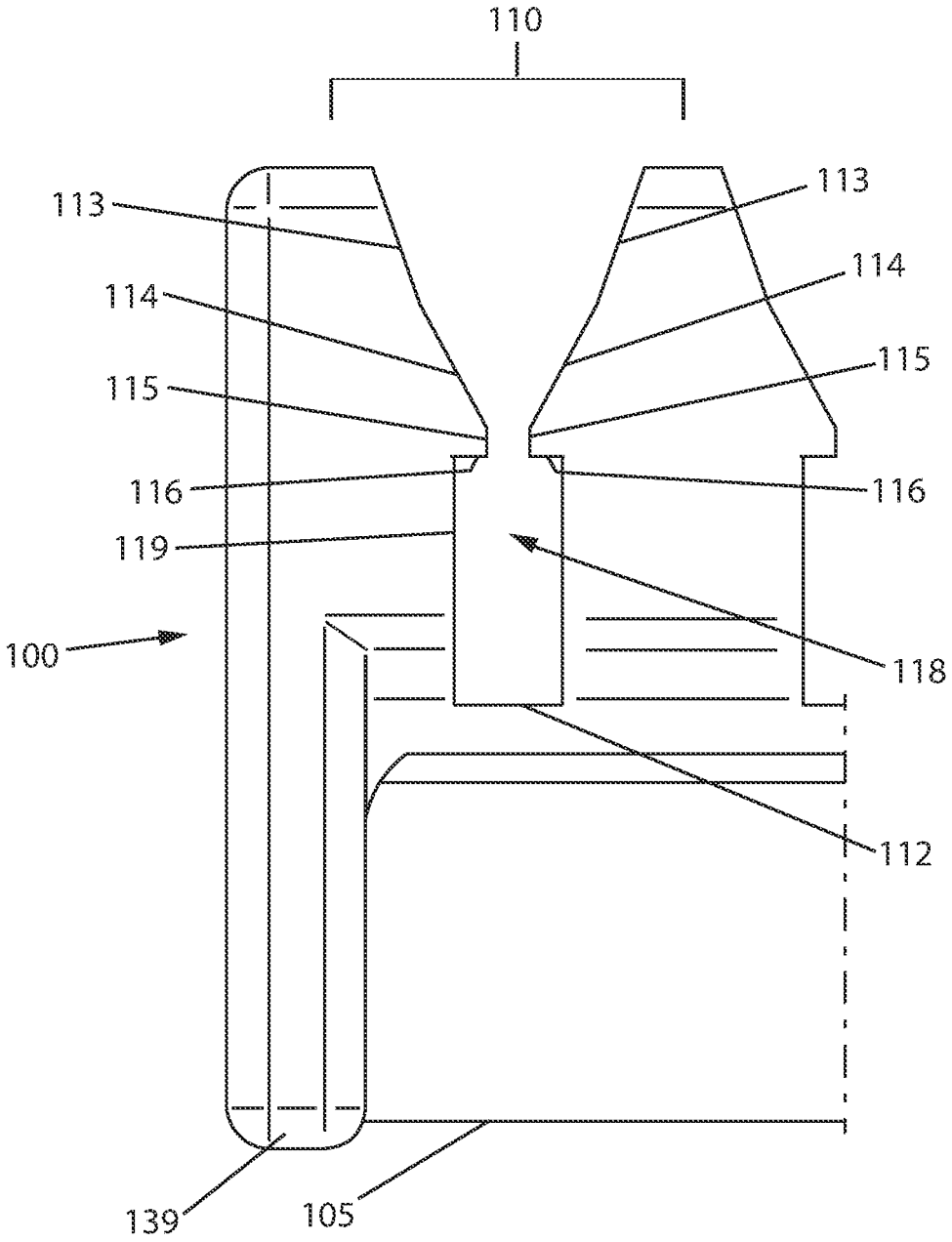
FIG. 5C is a front elevation view s f a portion of one embodiment of the housing of the invention.

The structure of the housing 100 is shown in greater detail in FIGS. 5A, B and C. In the embodiment shown in FIG. 5A, the housing 100 is generally rectangular in structure, having a bottom surface 105, which, when assembled with a printed circuit board (PCB) 200 will face the top flat surface of the PCB 200 (see FIG. 4). In one embodiment, the housing 100 has offsets 139 on the bottom surface 105 of the housing. Offsets 139 serve to contact the PCB 200 evenly and offset the bottom surface 105 from contact with the PCB 200. The offsets 139 cease forward motion and properly level the connector 100 against the top of PCB 200.

Figure 6:
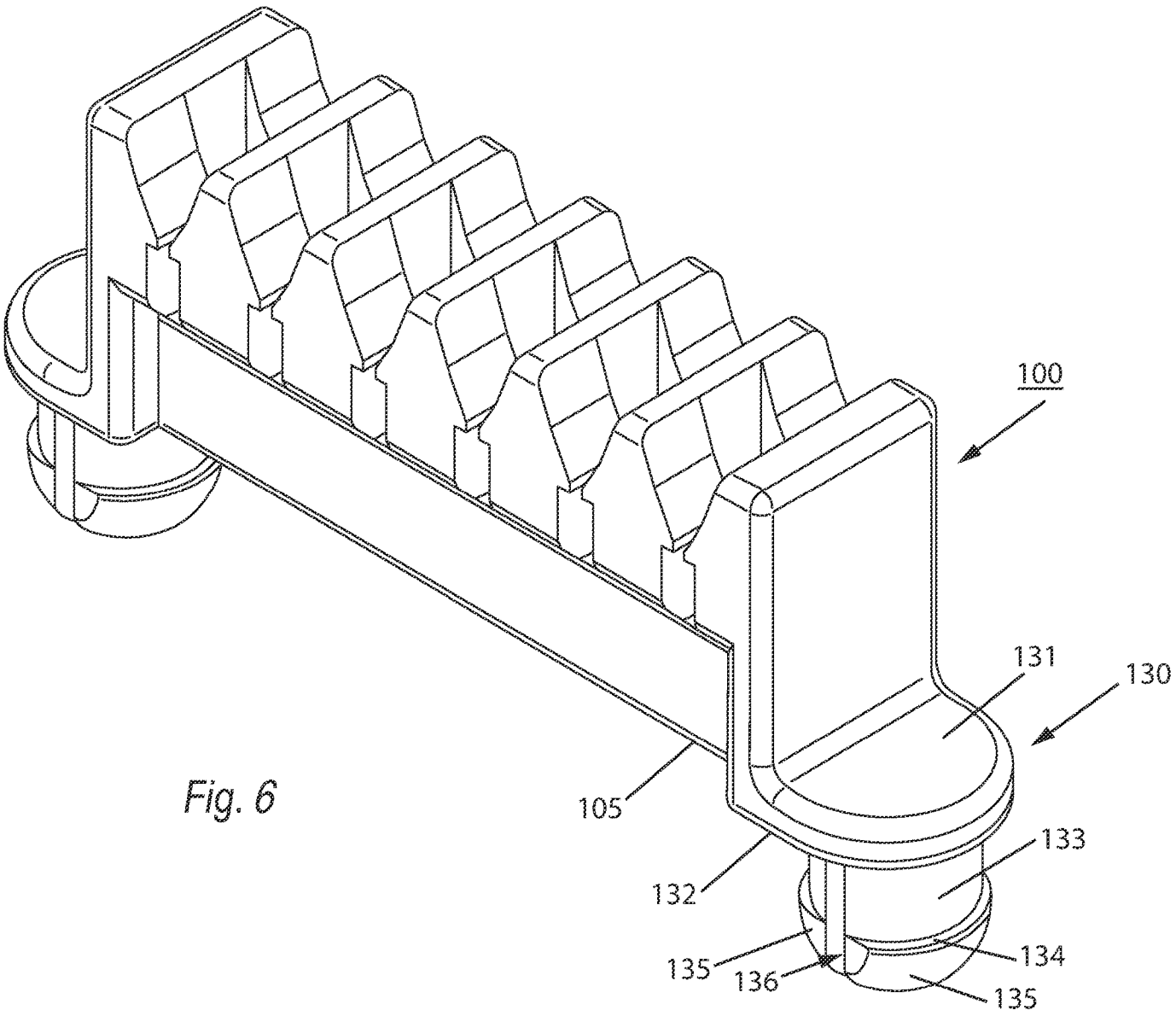
FIG. 6 is a perspective view of another embodiment of the housing of the invention.

In the embodiment shown in FIG. 6, a pair of optional retention posts 130 are present. The retention post 130 extends from an underside 132 of a pedestal 131 attached to the side of the housing 100, and below the bottom surface 105 of the housing 100. The underside 132 of the pedestal 131 being parallel to the top of a PCB, and the bottom surface 105 of the housing to properly level the connector 100. The retention post 130 includes a first protrusion section 133 formed by two halves extending from an underside 132 of a pedestal 131, and a second protrusion section 135 formed by two halves at the end of the first protrusion section, with a gap 136 between both sections 133, 135. The retention post 130 is designed to It in a hole in a printed circuit board. Typically, a respective hole will be in a PCB, so as to allow the protrusion sections 133 and 135, which are cylindrical, and the second protrusion section 135 wider than the first protrusion section 133, to pass through. The second protrusion section 135 is wider than the PCB hole so as to lock the retention post 130 into a respective PCB hole after insertion. On the upper end of the second protrusion section 135 is a flat sided edge 134 that s parallel to the bottom of a PCB, such that the flat sided edge 134 abuts the underside of the PCB after insertion through the PCB hole. The second protrusion section 135 is also of a domed shape which aids in insertion, wherein the two halves of the second protrusion section 135 flex toward one another during insertion, such that the second protrusion section 135 fits through the hole in the PCB. In order to lock the retention post 130 into the PCB, the two halves of the second protrusion section 135 unflex after insertion through the hole to allow the rearward facing flat sided edge 134 to abut the underside of the PCB 200 and the side walk of the first protrusion section 133 to abut the inner edge of the hole.

The housing 100 is designed o accept a plurality of IDCC header pins and has a plurality of rectangular negative spaces 102 into which the IDCC header pins 300 can reside. As can be seen in FIGS. 5A and B the rectangular negative space 102 provides an opening in the crosswise direction and includes a hole 123 penetrating the bottom surface 105 of the housing, such that there is an opening in the vertical direction. Each negative space 102 is defined by side walls that are complementary to side walls of the upper section 301 and pin barb section 302 of the IDCC header pin 300. These side walls include upper side walls 117 for engaging the side walls 316 of upper section 301 of the IDCC header pin and lower side walls 122 for engaging sides 328 and pin barbs 319, 323 of pin barb section 302. At the boundary between the upper side walls 117 and the lower side walls 122 is stop portion 120, which can engage the forward stop 318 of the upper section 301 of IDCC header pin 300.

The lower portion of the negative space 102 includes a hole 123 penetrating the bottom surface 105 of the housing. Around the middle portion of negative space 102, the housing is shaped to have angled edges forming a housing lead-in chamfer 121. The housing lead-in chamfer 121 is designed to engage IDCC header pin barb lead-in chamfer 326, to guide the tip 340 of the IDCC header pin 300 through the hole 123 in the bottom 105 of the housing 100, so that the tip 340 is positioned to penetrate a respective hole 201 in the printed circuit board 200. In addition, housing lead-in chamfer 121 engages barb lead-in chamfer 326 of the IDCC header pin, to seat the pin barb section 302 into the housing 100 and prevent stubbing of the pin 300 (see FIG. 4).

The housing 100 also has features surrounding the negative spaces 102 which assist in the insertion of a wire into the IDCC header pin 300. As illustrated in FIGS. 5A, B, and C the housing has strain reliefs 110. The strain reliefs 110 are an inverted triangular lead-in, having a first surface 113, and a second surface 114. A channel 118 is formed down the center of the strain relief 110 leading to and across the rectangular negative space 102 from the sides of the housing 100. The function of strain relief 110 is to provide a lead-in for a wire 400 prior (see FIG. 9A, B) to the wire 400 being applied to the blade of the IDCC header pin. Part of the lower end of the second surface 114 is an overhang 115 extending out from the channel walls 119, which has a lower surface 116 parallel to a channel lower surface 112 of the housing 100. Below the overhang 115 and surrounding the channel 118 are channel walls 119 perpendicular to the channel lower surface 112. In use, the width of the channel 118 between the overhangs 115 is smaller than the gap 312 between opposing surfaces of the blade 315 of the inserted IDCC header pin 300 (see FIGS. 4, 10A-D). Below the overhangs 115, the width of the channel 118 between channel side walls 119 is greater than the distance of the gap 312 between opposing surfaces of the blade 315 of the inserted IDCC header pin 300 (see FIG. 4, FIGS. 10A-D).

Figure 7A:
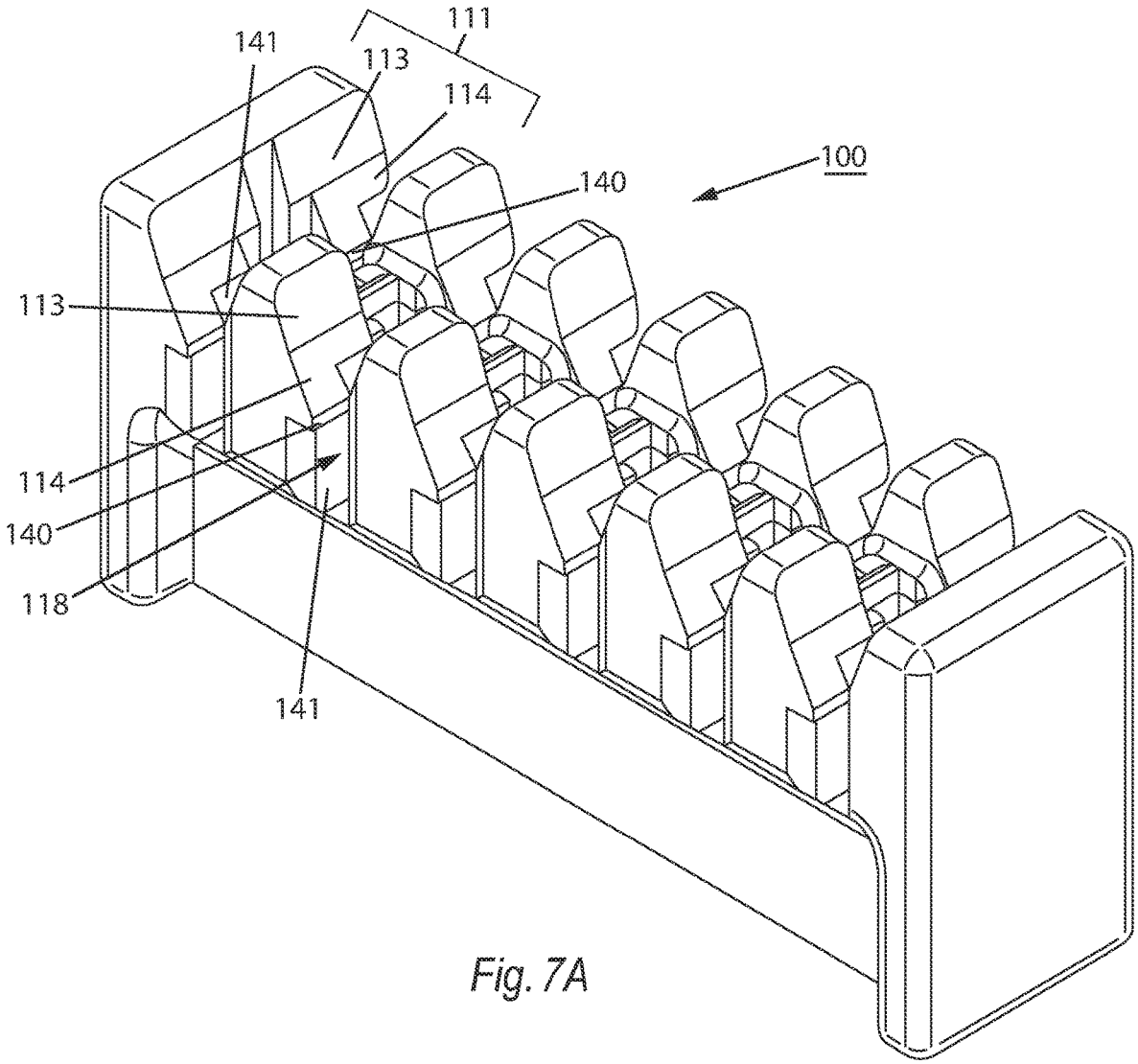
FIG. 7A is a perspective view of another embodiment of the housing of the invention.
Figure 7B:
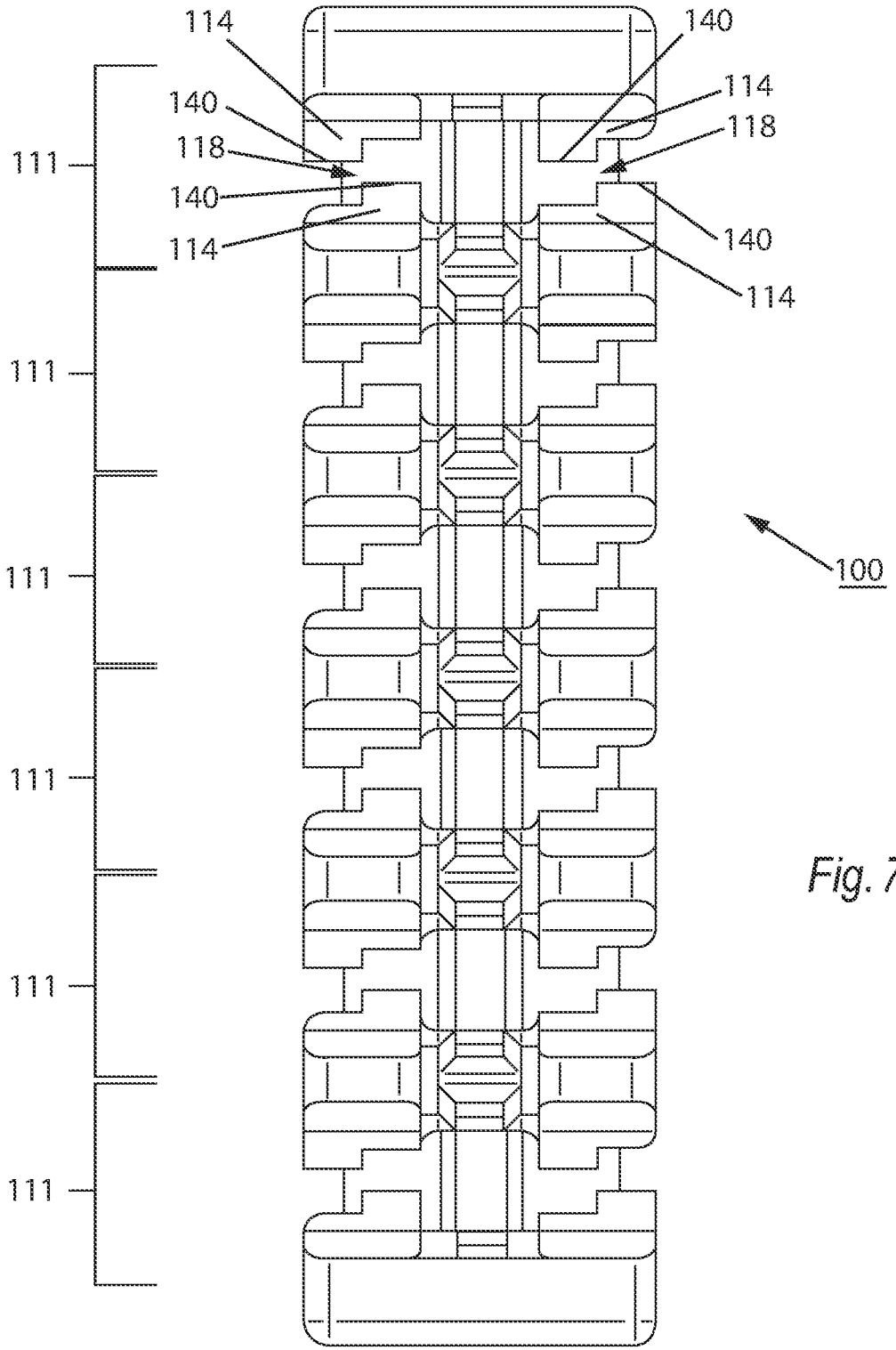
FIG. 7B is a top view of an embodiment of FIG. 7A.
Figure 7C:
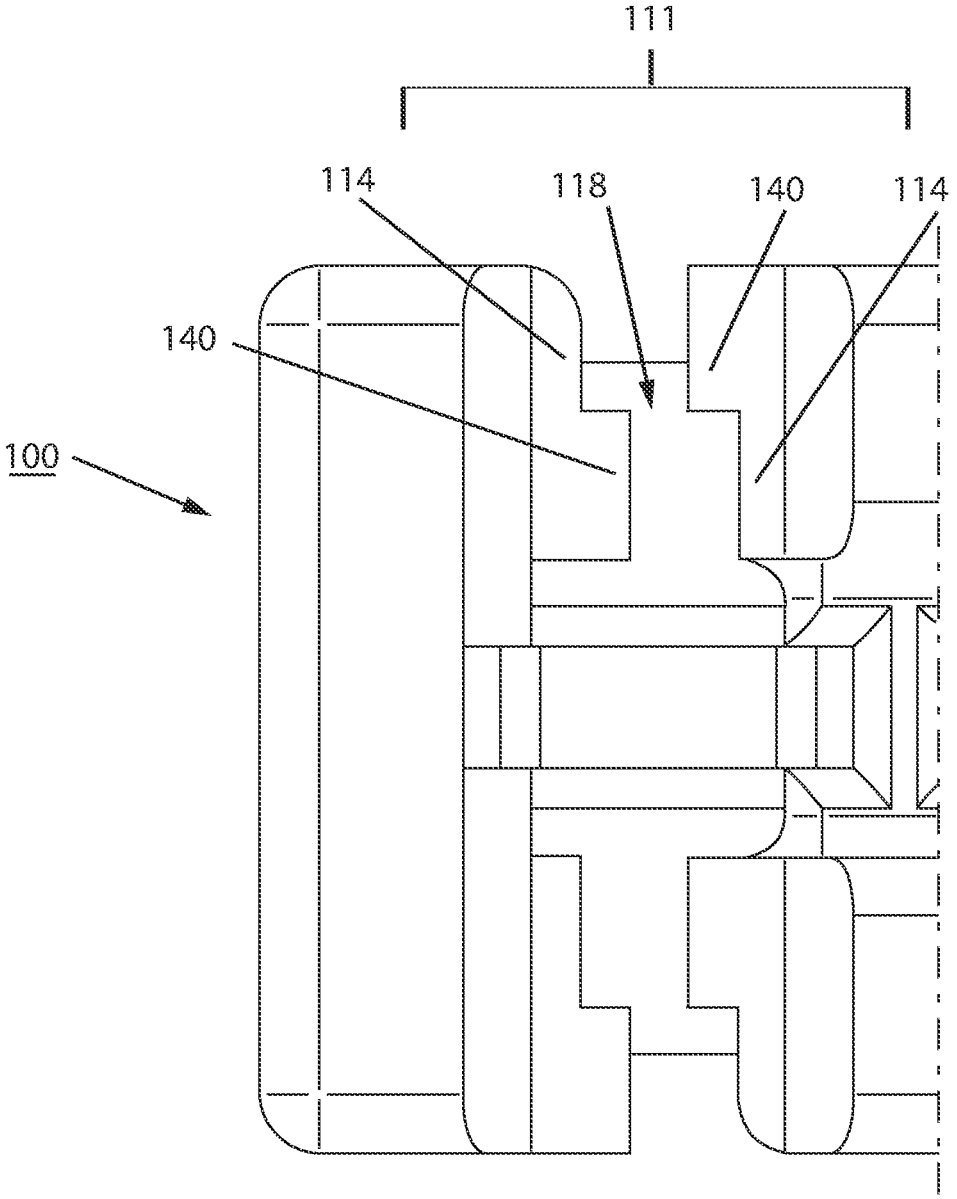
FIG. 7C is a close-up top view of a portion of the embodiment of 7A.
Figure 7D:
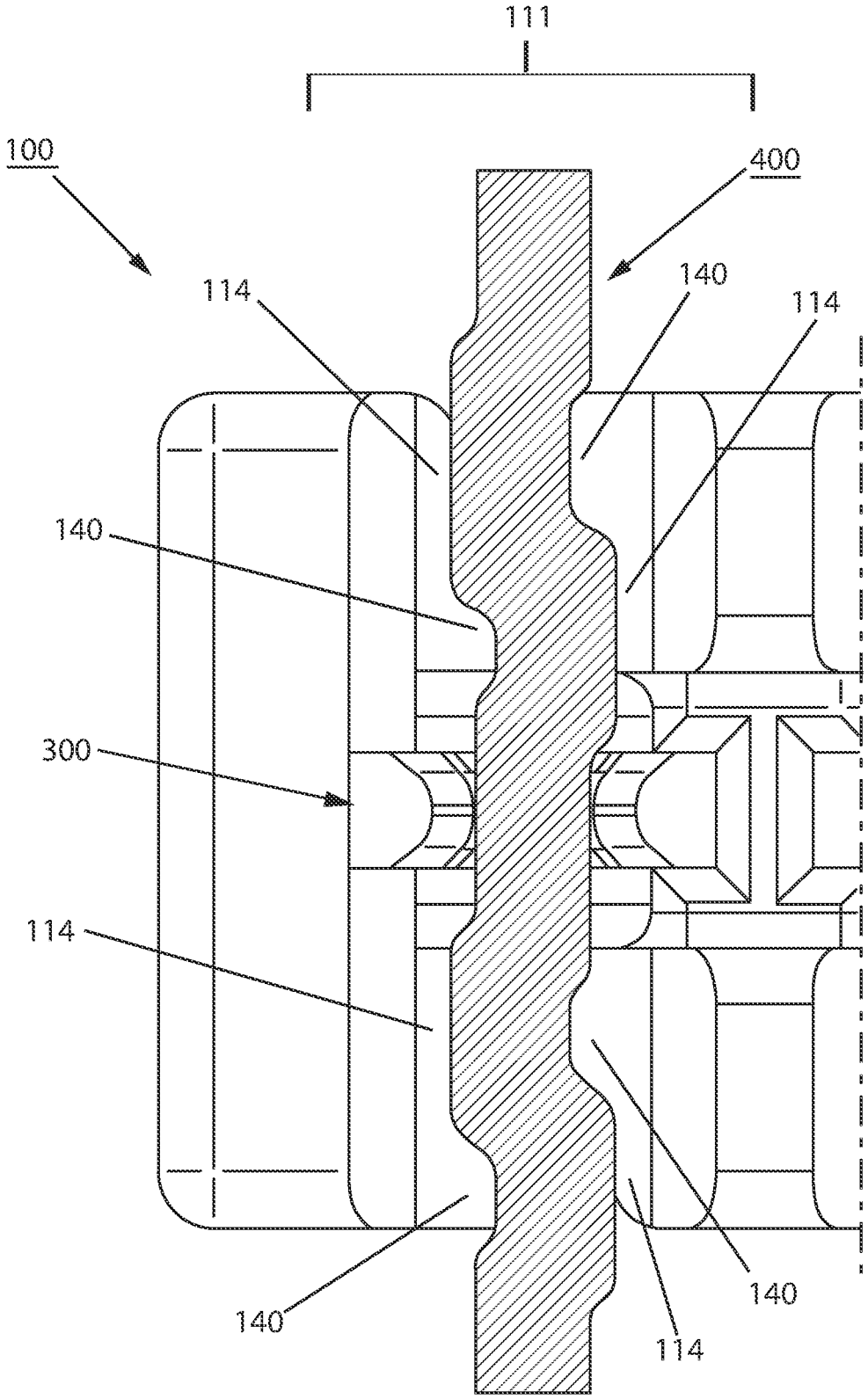
FIG. 7D is a top view of the embodiment of FIG. 7A, illustrating a e assembled to the system of the invention.

In another embodiment of the housing, as shown in FIGS. 7A, B, C and D a twisting strain relief is provided. The twisting strain relief 111 includes offset overhangs 140 and offset channel wall 141. As seen in FIG. 7D, when a wire 400 is inserted into the housing 100, the wire is deformed and conformed to the structure of the offset overhangs 140 of the lower surface 114 of the strain relief.

Typically, in use, IDCC header pins 300, a housing 100 and a PCB 200 will be assembled and then wires 400 will be inserted into the blade 315 of the IDCC header pins 300. There are several options for this assembly process. A first embodiment of the assembly process includes: a) a pin-to-housing insertion process; b) a housing assembly-to-PCB assembly process; and c) a wire-to-housing assembly assembly process. This assembly is explained below with regard to the steps of the first embodiment:

a) Pin-to-Housing Assembly

A typical pin-to-housing assembly process is shown 8A-E. FIGS. 8A-E illustrate the process for one IDCC header pin and one negative space 102 in a housing. It will be understood that a typical housing will hold a plurality of IDCC header pins (see FIG. 4) and that these pins may be inserted simultaneously or sequentially into the negative spaces 102 in the housing.

Figure 8A:
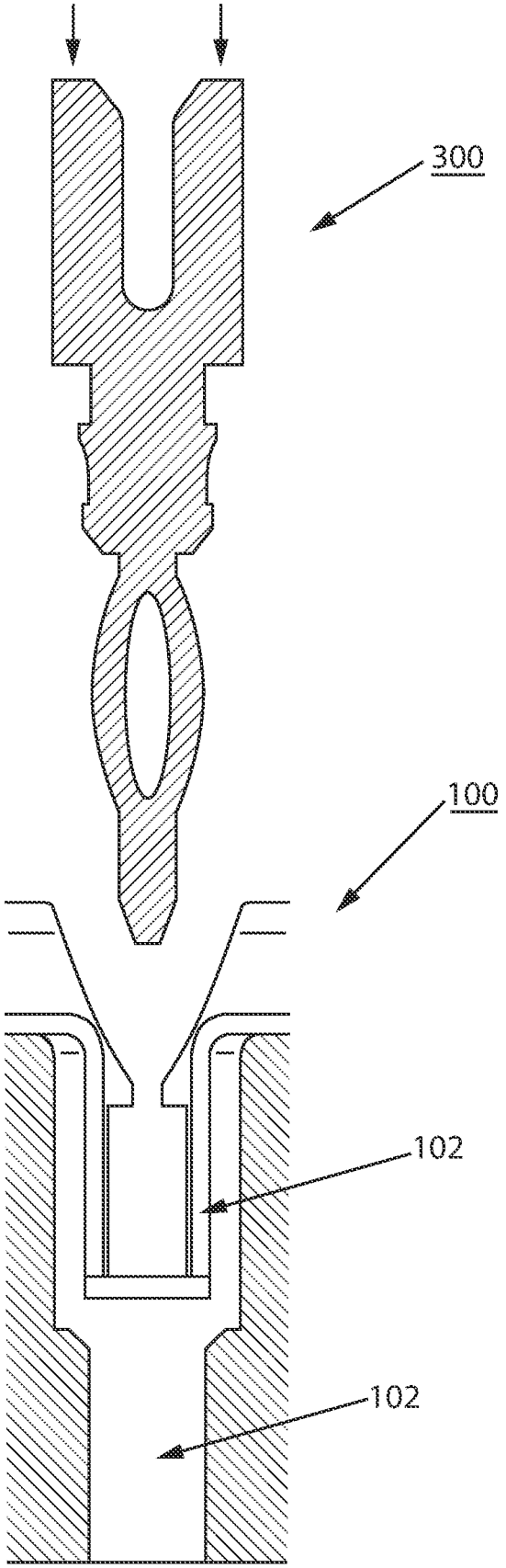

As shown in FIG. 8A, an IDCC header pin is aligned with one negative space 102 on the housing 100, and an insertion three is applied to the IDC flat 310. This force may be applied by a machine/jig (not shown).

Figure 8B:
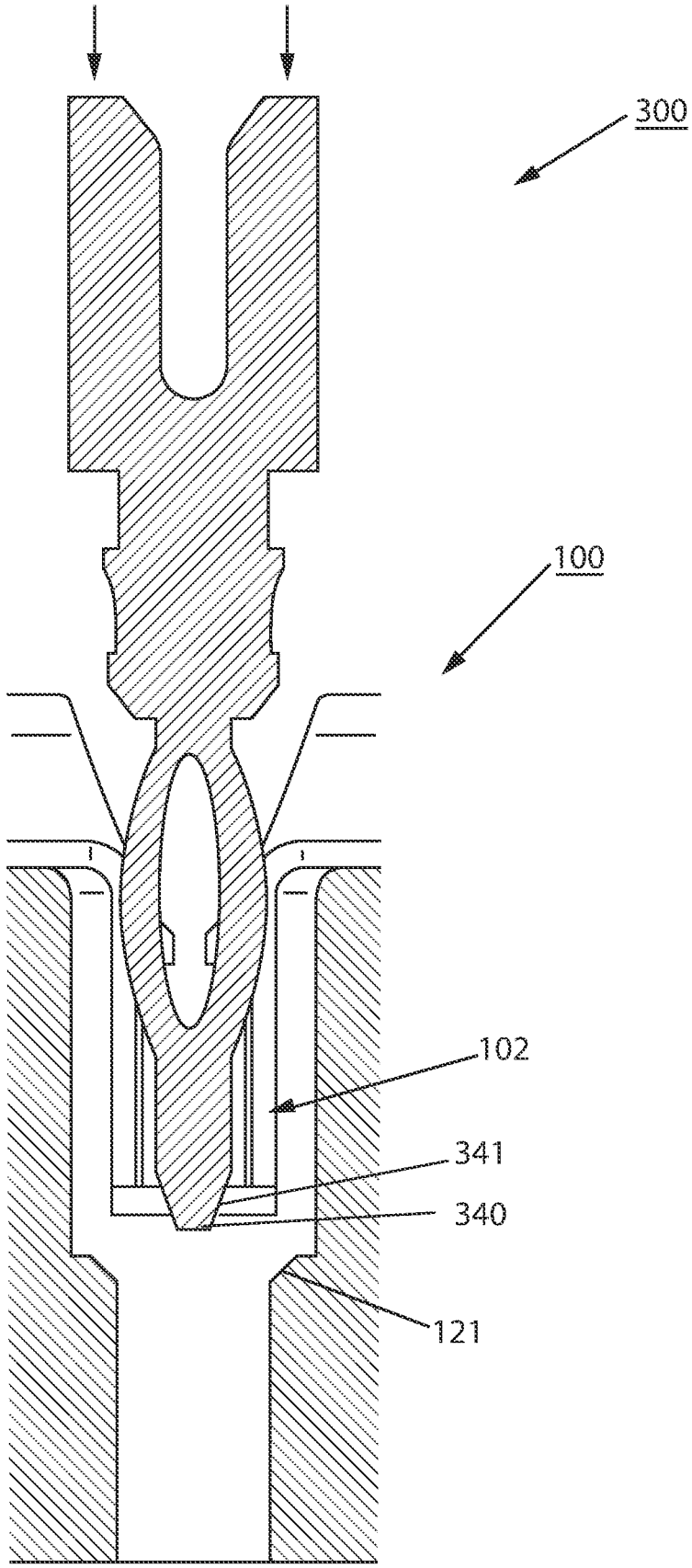

In FIG. 8B, force continues to be applied and the IDCC header pin 300 is inserted partway into the housing 100, where contact might be made between housing lead-in chamfer 121 and pin lead-in chamfer 341. If such contact occurs, housing lead-in chamfer 121 guides the IDCC header pin tip 340 into the lower portion of the rectangular negative space 102.

Figure 8C:
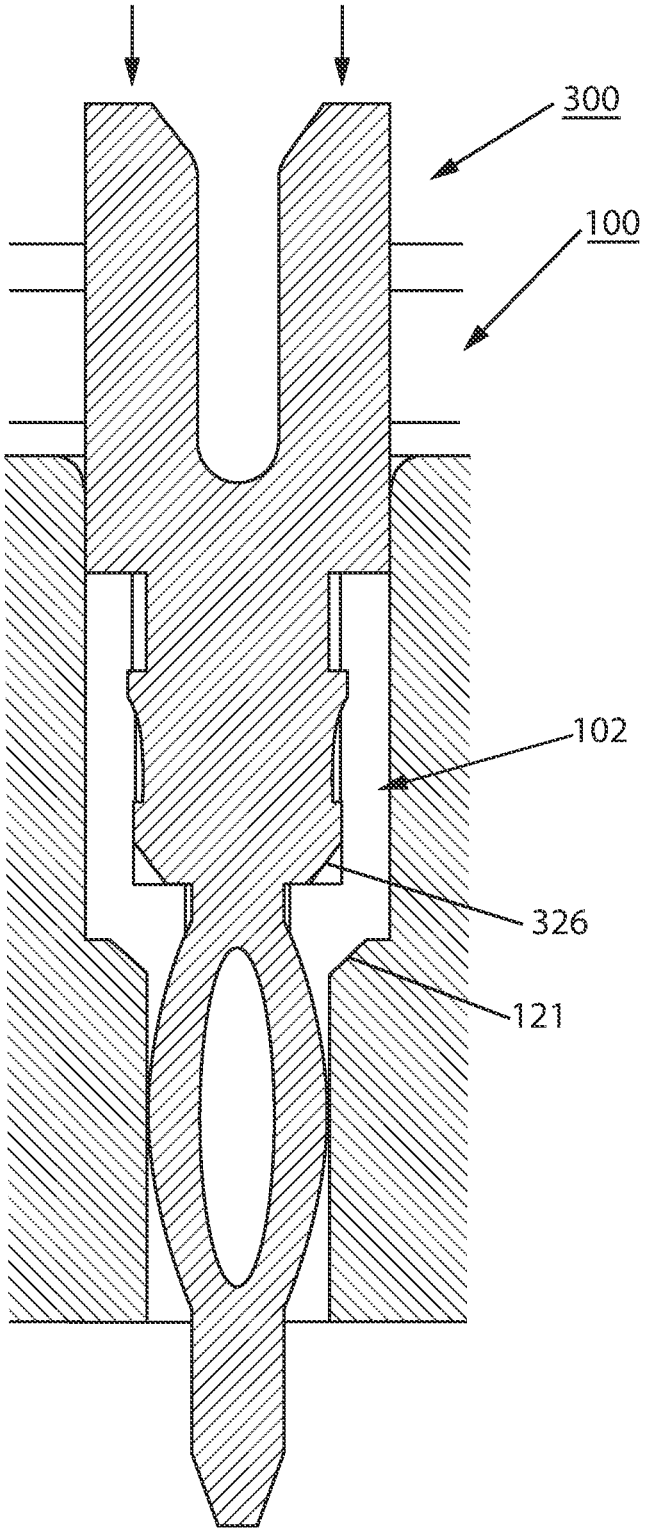

In FIG. 8C, force continues to be applied and the IDCC header pin 300 is inserted further into the housing 100, where IDCC header pin barb lead-in chamfer 326 might engage housing lead-in chamfer 121. The chamfers serve to guide the barb section 302 of the pin into the lower portion of the rectangular negative space 102 without stubbing of the pin 300.

Figure 8D:
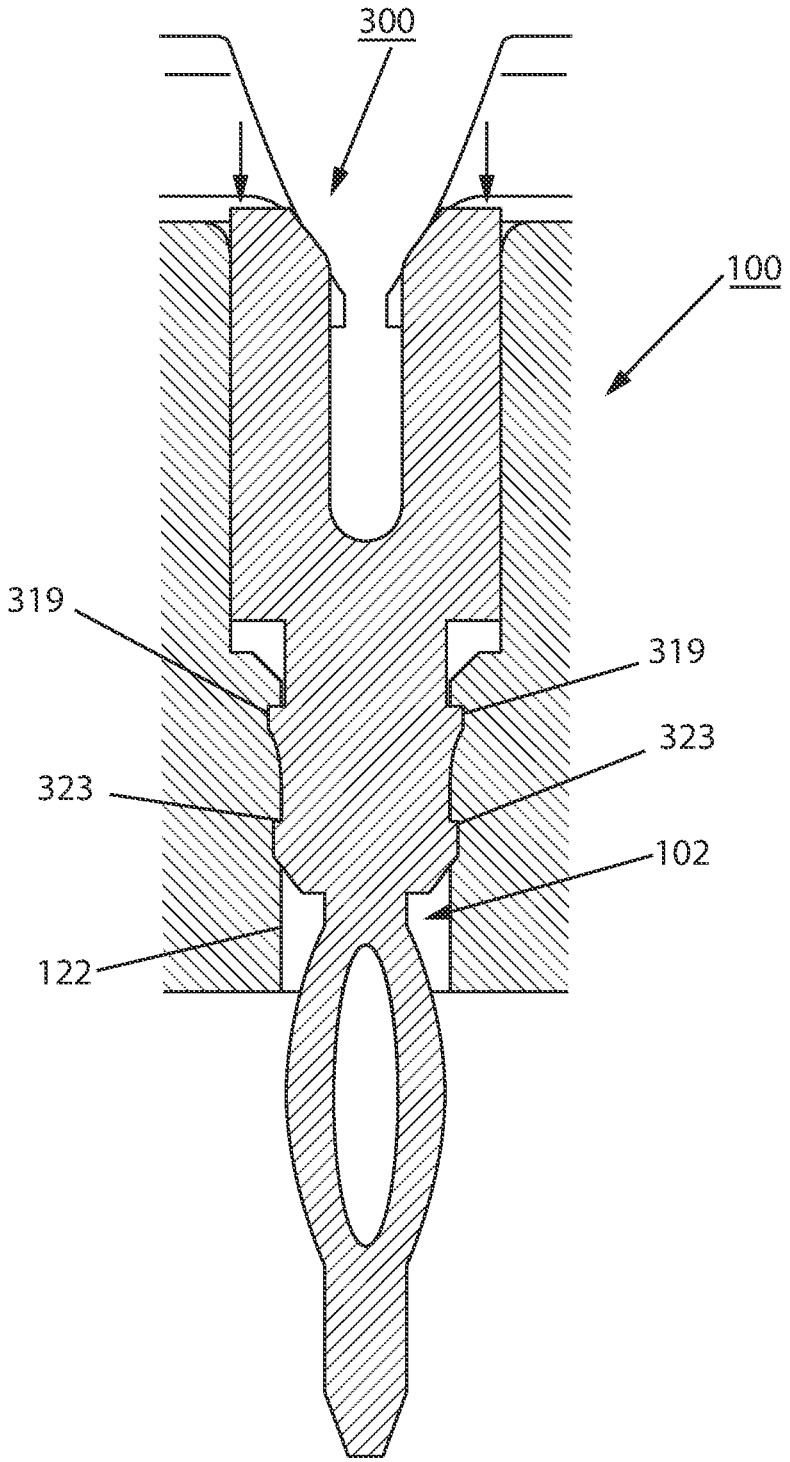

In FIG. 8D, force continues to be applied and the IDCC header pin is inserted further into the housing 100, where first pin barb 319 and second pin barb 323 contact the side walls 122 of the lower portion of the rectangular negative space 102. This contact results in a retention force holding the pin place.

Figure 8E:
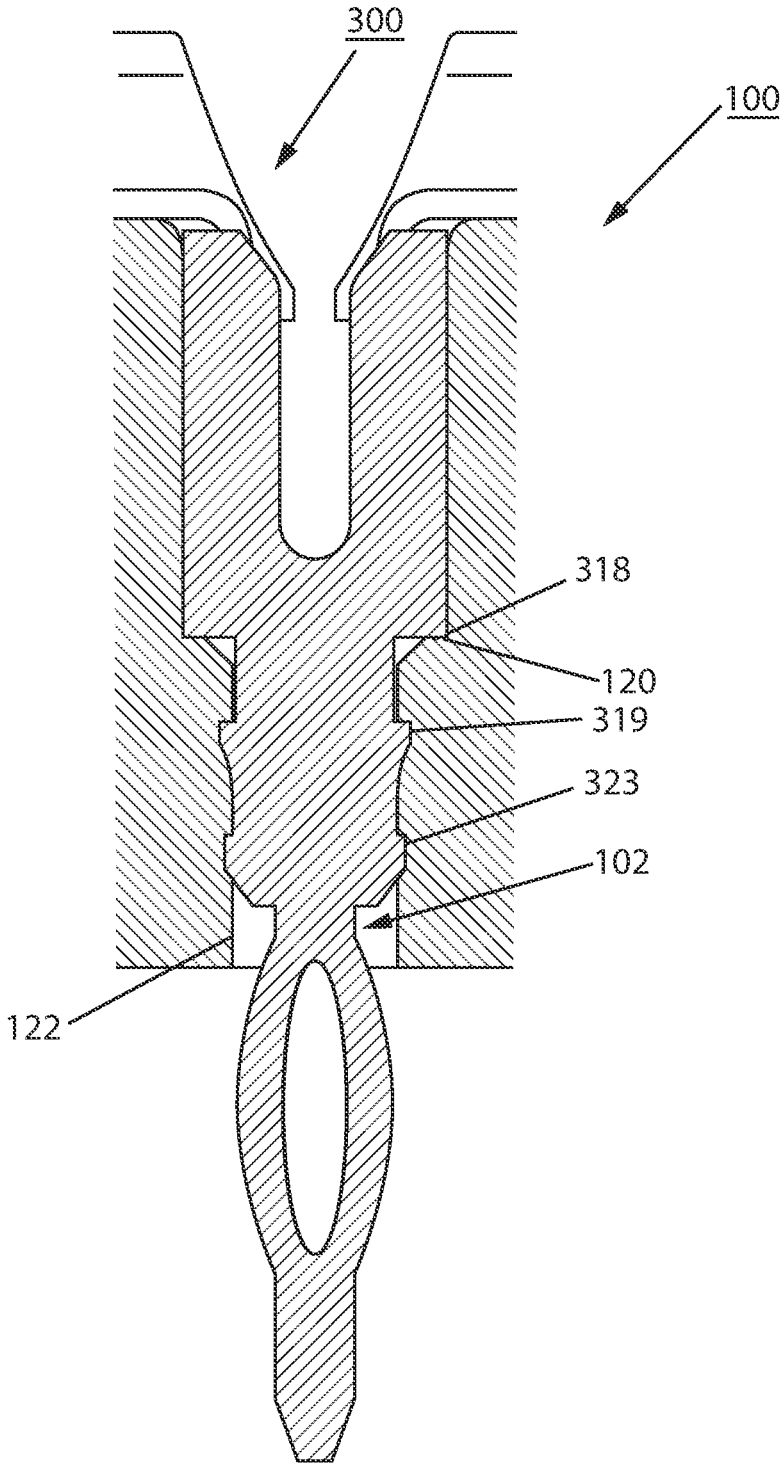

In FIG. 8E, force is applied until the IDCC header pin forward stop 318 comes into contact with housing stop portion 120, at which point movement of the IDCC header pin 300 into the housing 100 stops and the IDCC header pin is seated and retained in the housing 100.

b) Housing Assembly-to-PCB Assembly Process

An exemplary housing assembly-to-PCB assembly process is shown in FIGS. 9A-D.

Figure 9A:
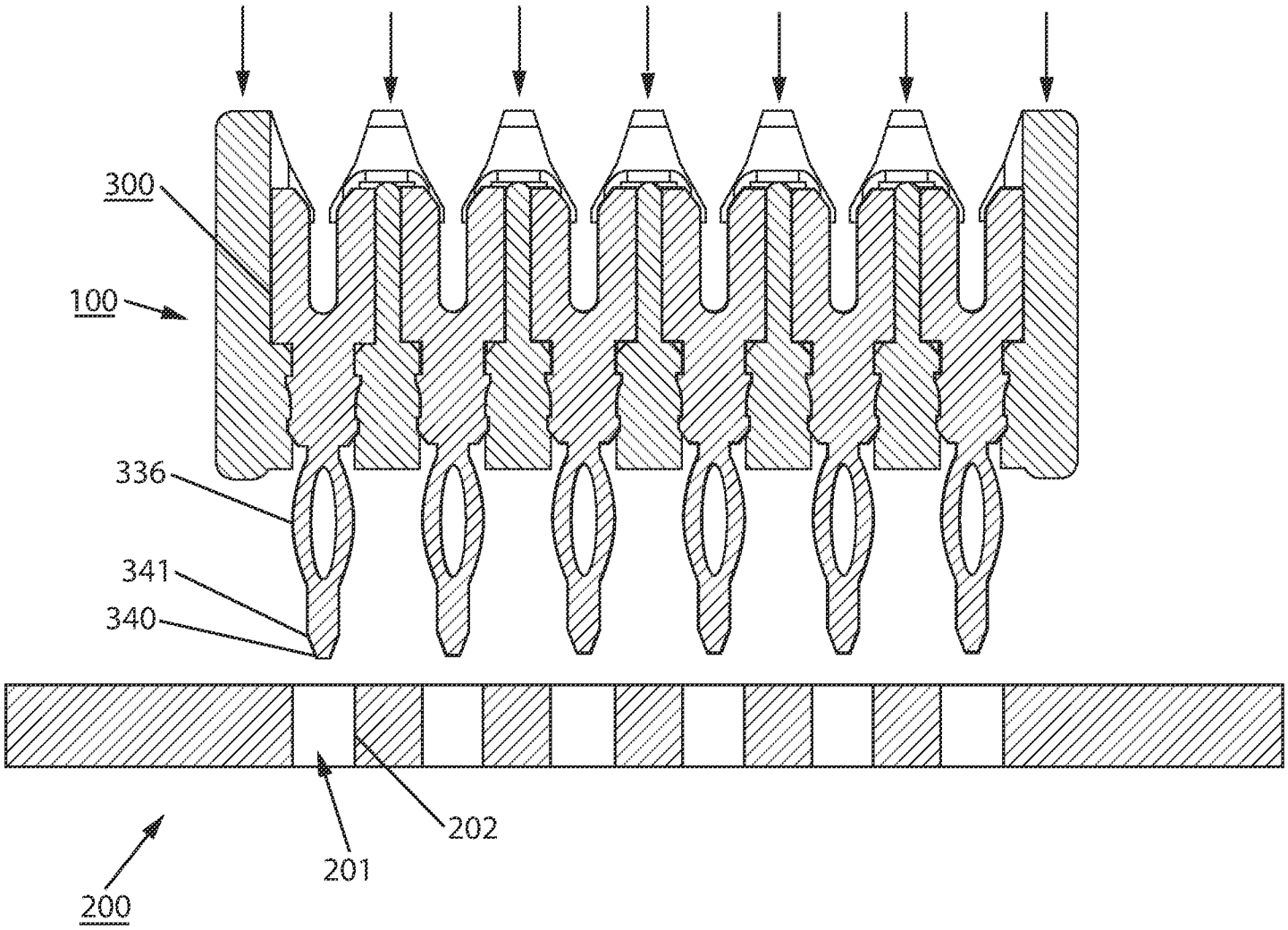

In FIG. 9A, housing 100 has been assembled with seven IDCC header pins 300 using the general pin-to-housing process described above, as a housing assembly. The housing assembly is then aligned with holes of a PCB 200 and pressure is applied as shown by arrows.

Figure 9B:
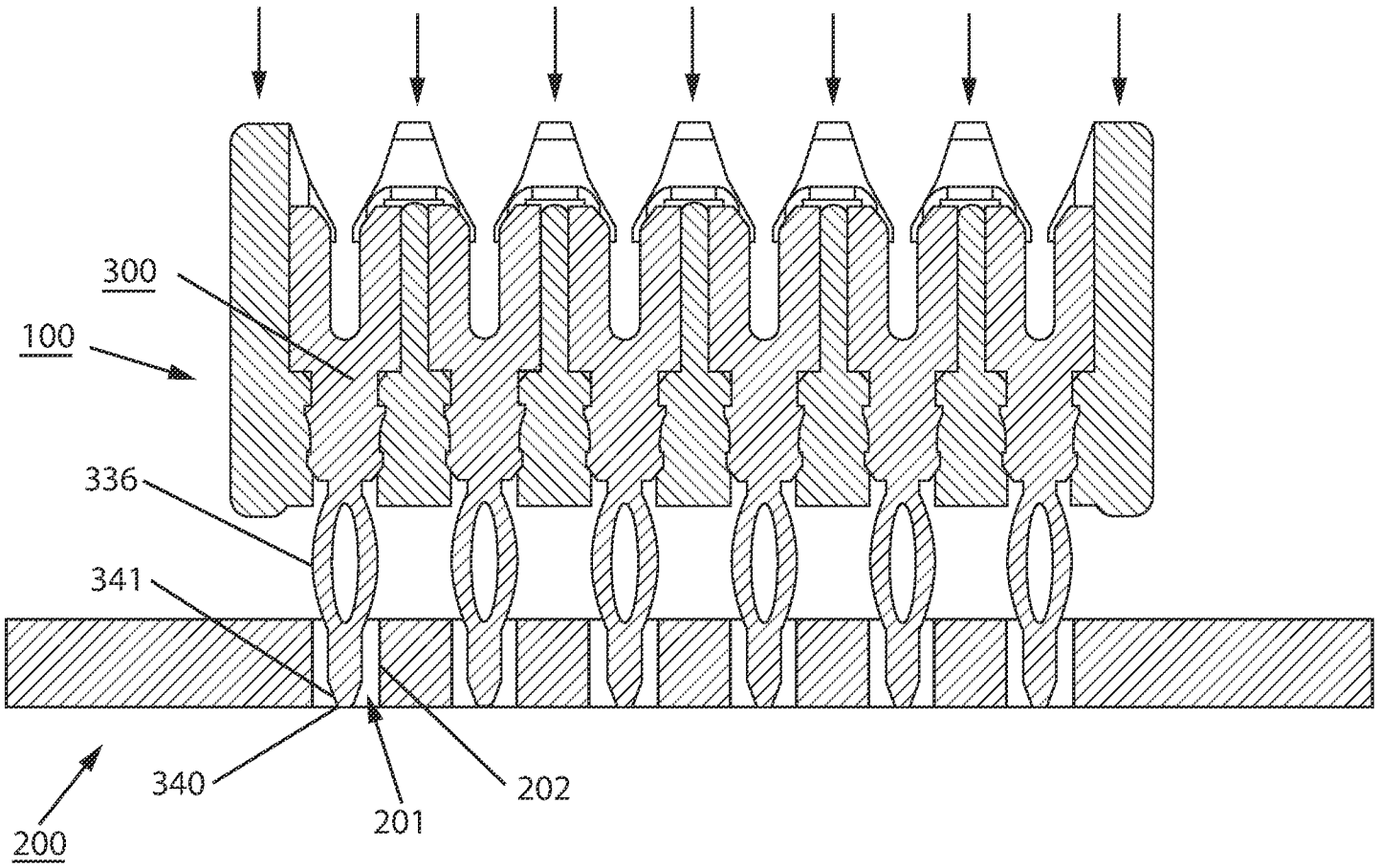

In FIG. 9B, the IDCC tip 340 and pin lead-in chamfers 341 penetrate holes 201 of PCB 200, the lower portion of the IDCC header pin 300 enters the hole 201.

Figure 9C:
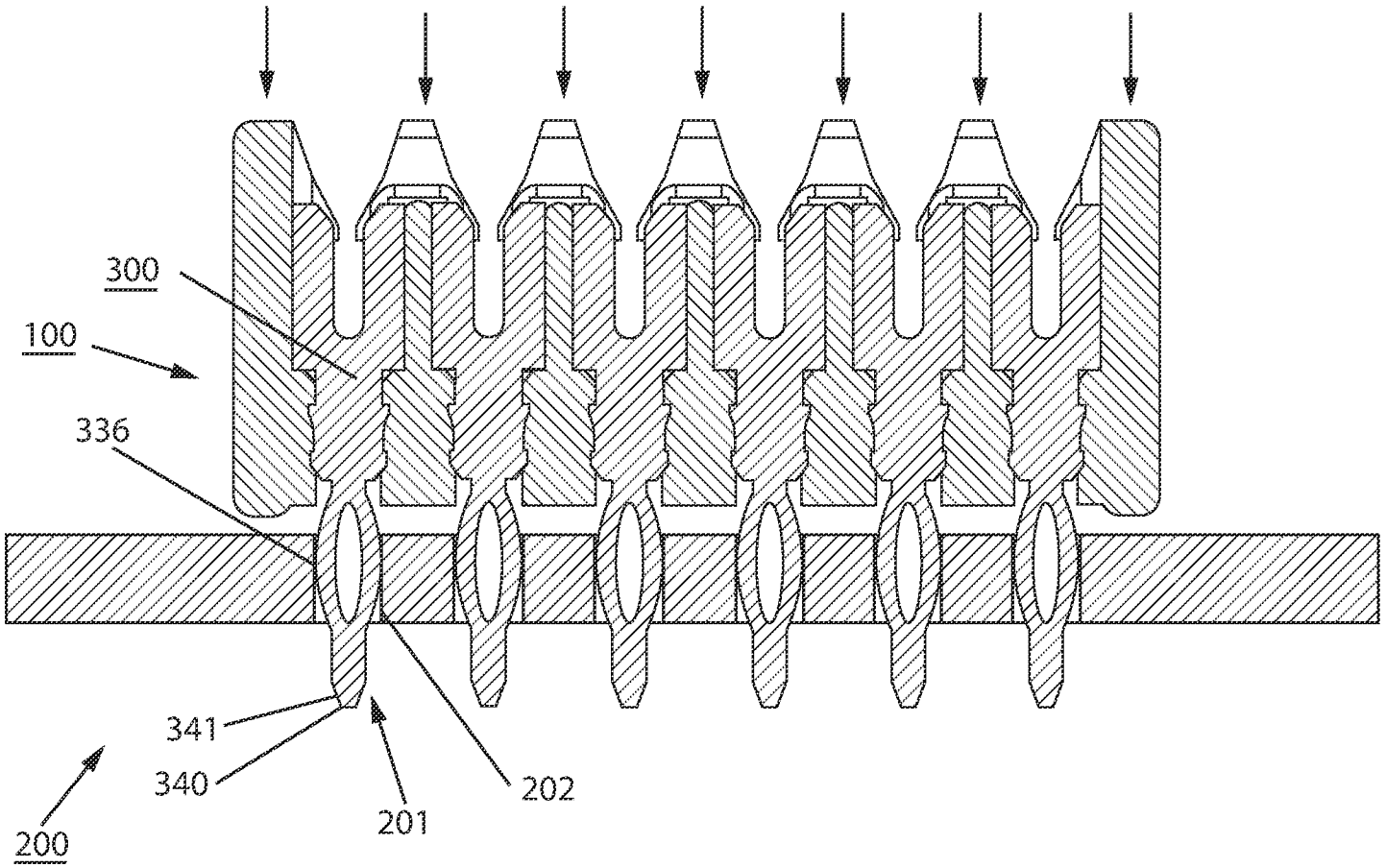

In FIG. 9C, the lower portion of the IDCC header pin enter holes 201 of PCB 200 further. The compliant features 330 are of an eye-of-the-needle shape and the side walls 336 provide elastic force outward as they are compressed by the holes.

Figure 9D:
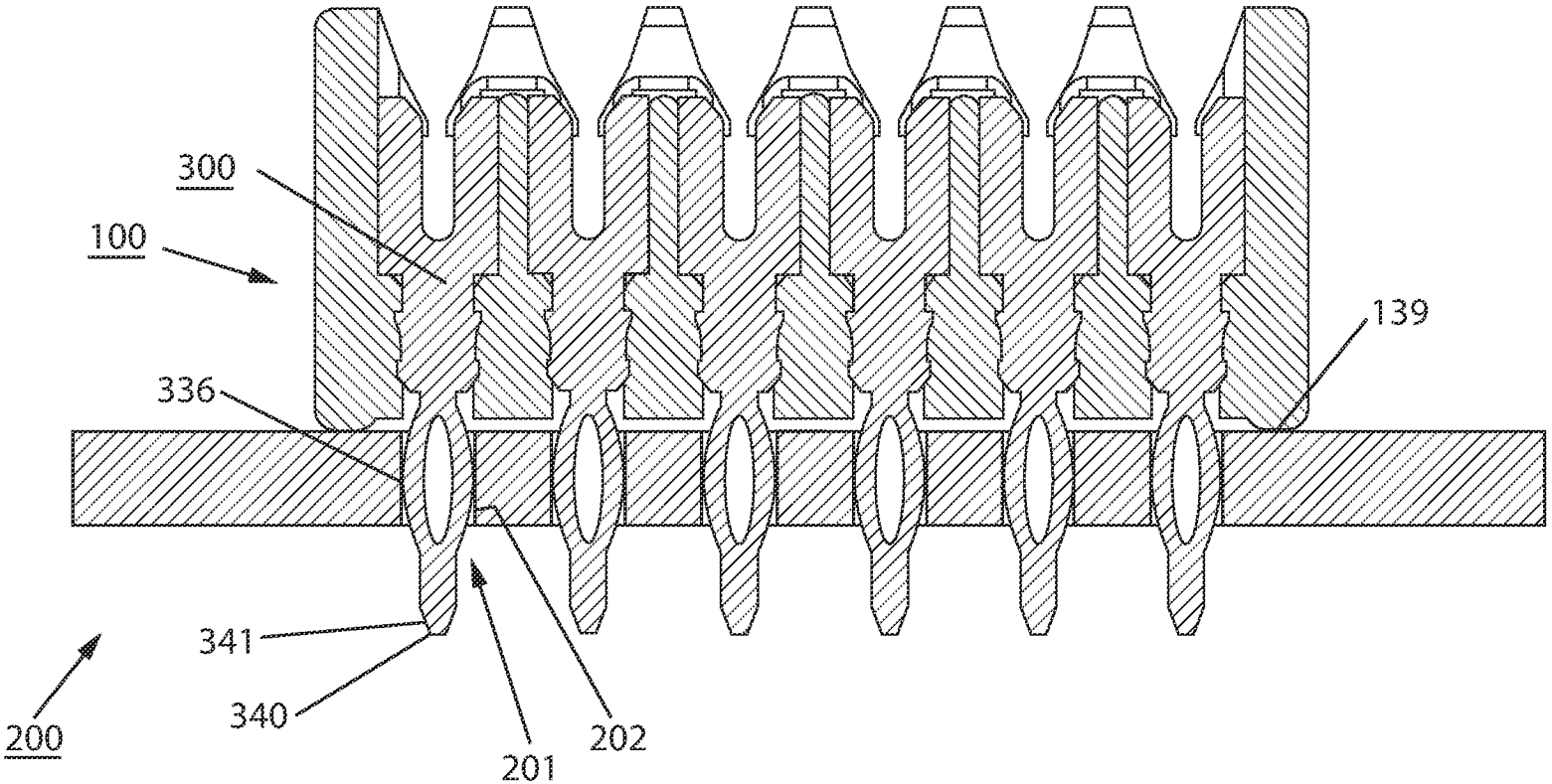

In FIG. 9D, pressure is applied until offsets 139 contact the surface of the PCB 200, whereupon downward motion ceases and the housing 100 is seated on the surface of the PCB 200.

c) Wire-to-Housing Assembly Process

A typical wire-to-housing assembly process is shown in FIGS. 9A-E.

Figure 10A:
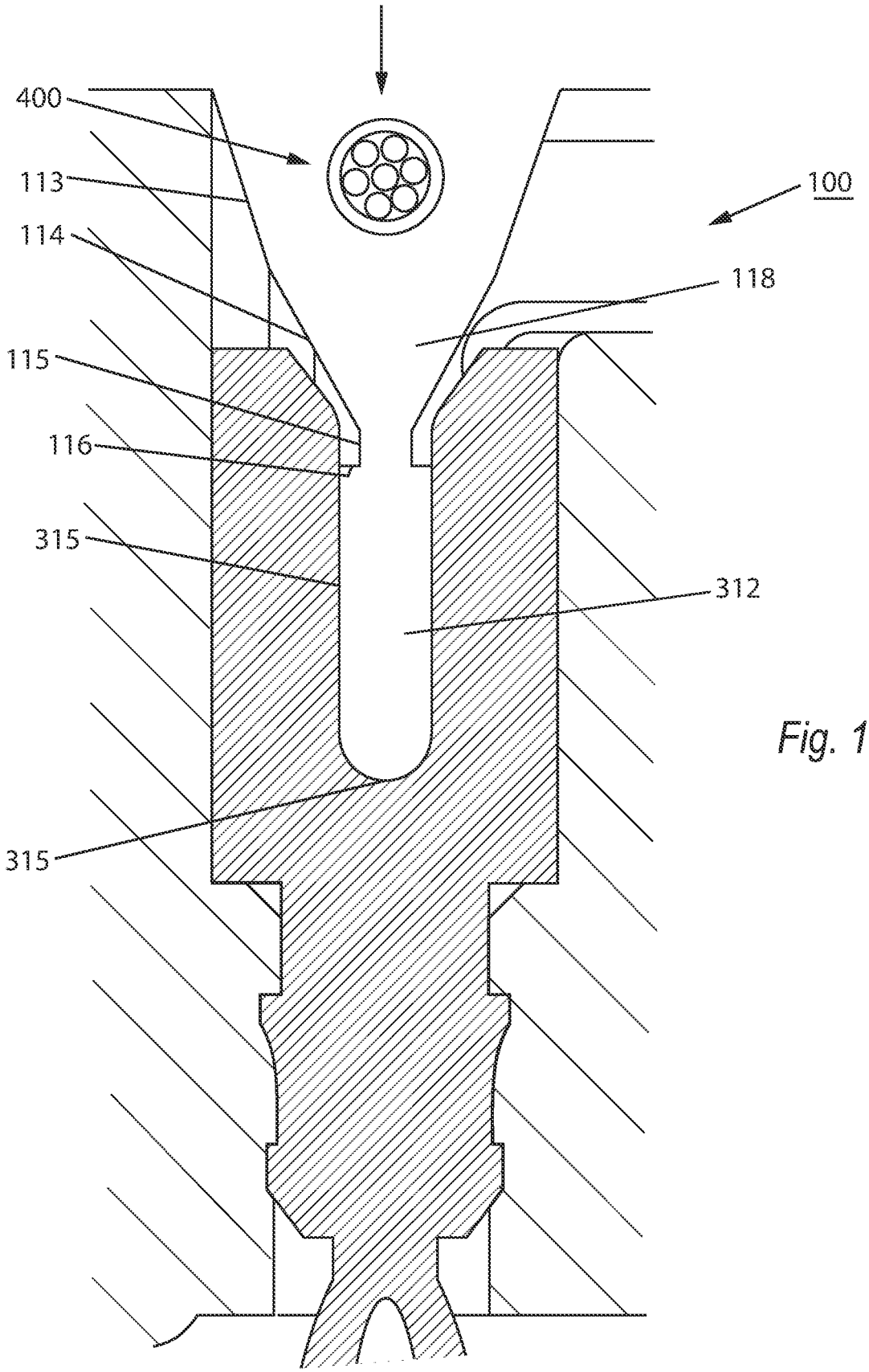

In FIG. 10A, wire 400 is positioned above the housing assembly, an IDCC header pin assembled therein. Downward force is applied to the wire 400.

Figure 10B:
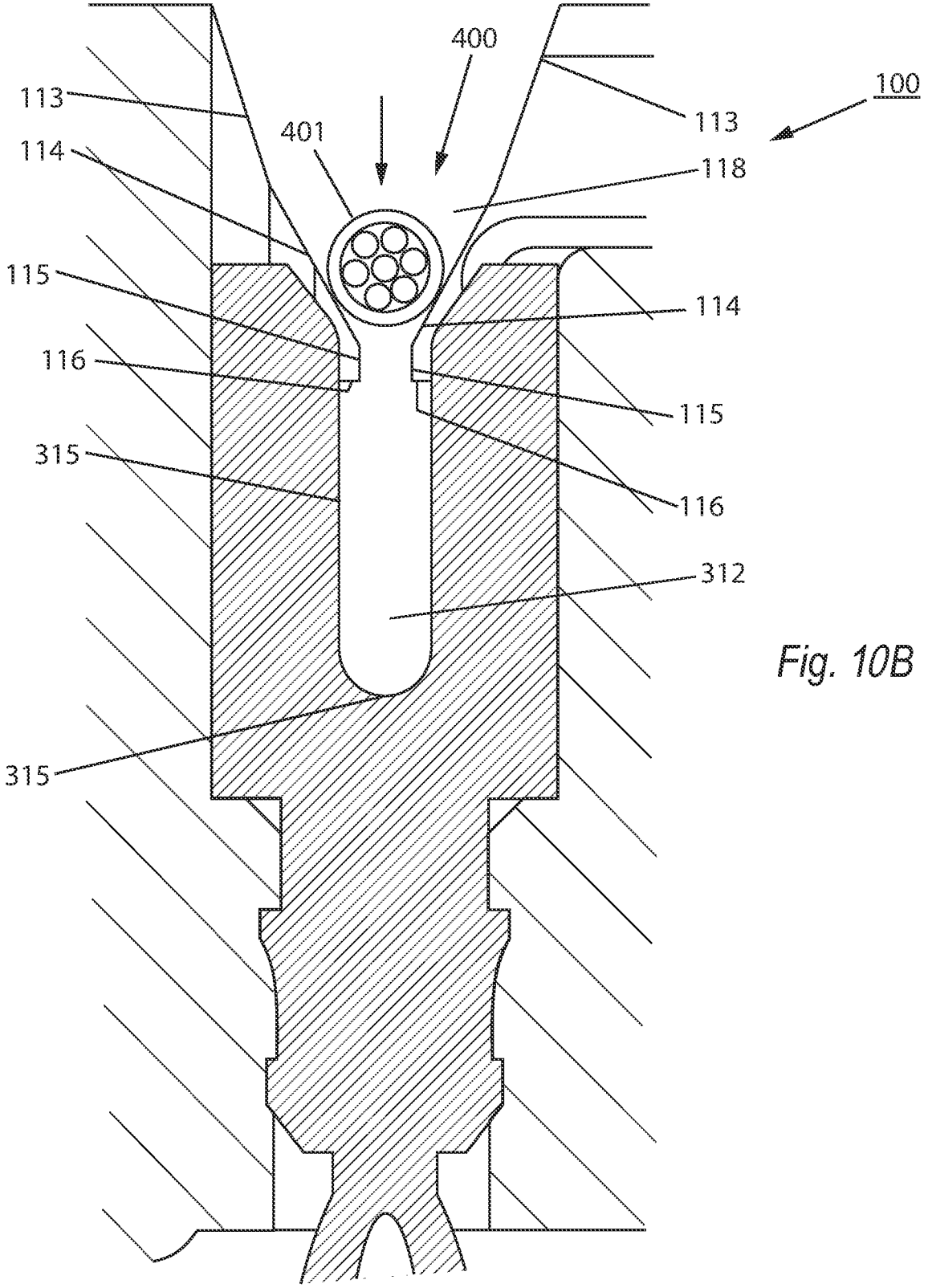

In FIG. 10B, the wire 400 contacts the lower portion 114 of the strain relief, which guides the wire 400 to be centered relative to opposite facing sides of the IDCC blade 315.

Figure 10C:
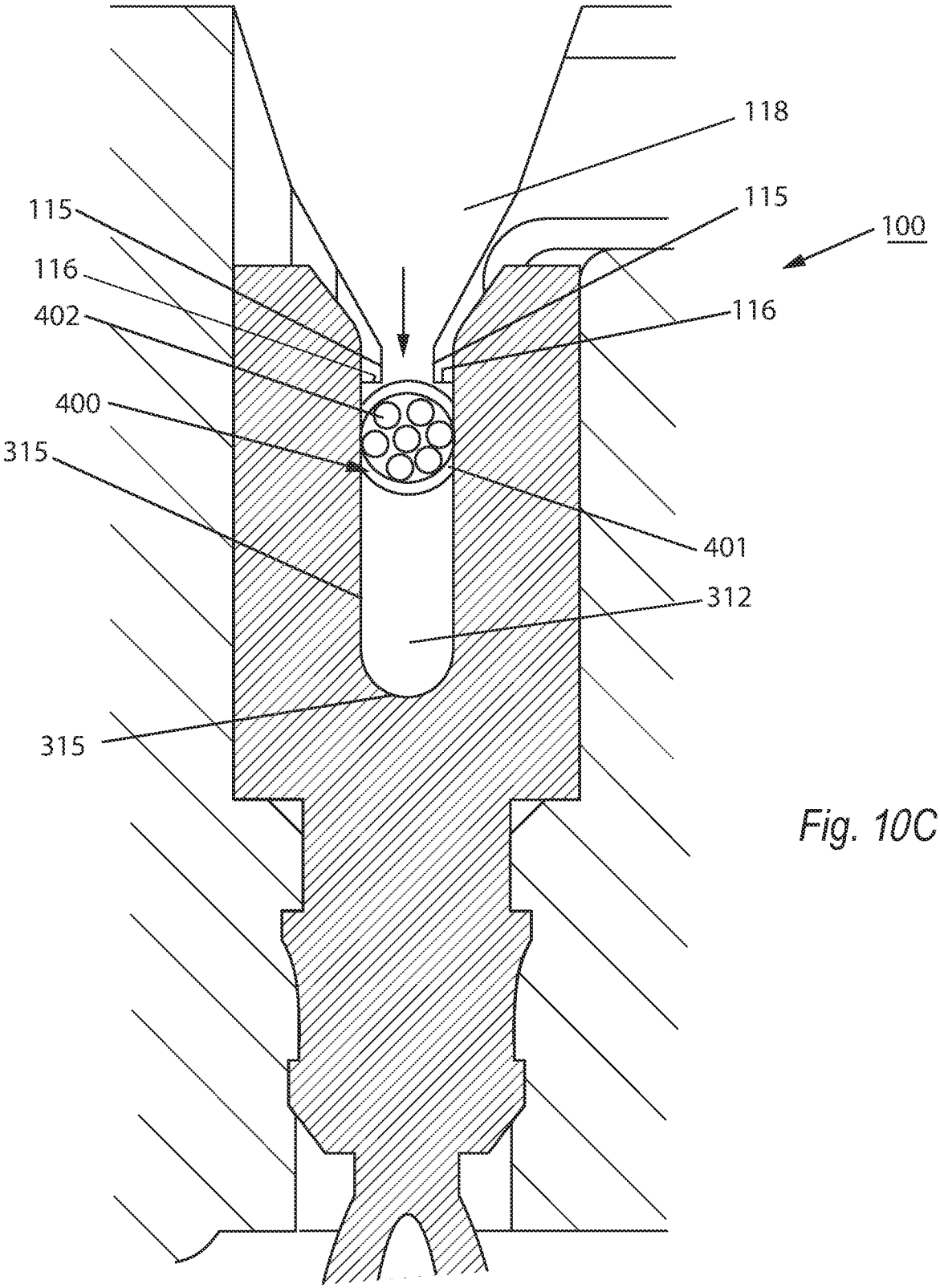

As shown in FIG. 10C, the strain relief causes the wire 400 to deform in order to pass the overhang 115.

Figure 10D:
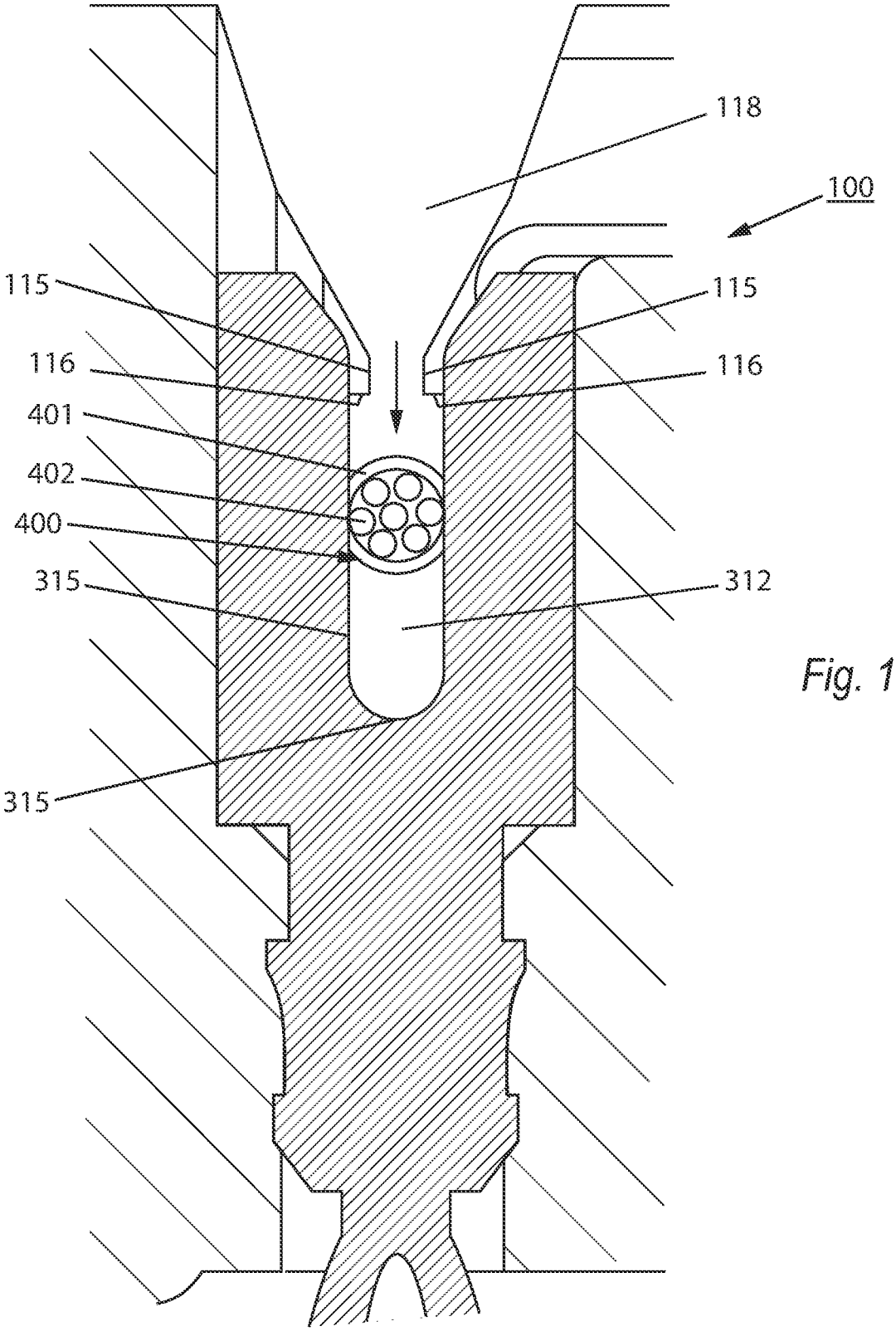

In FIG. 10D, the overhang 115 on the lead-in 114 secures the wire insulation 401 in place to maintain contact between the wire 400 and the IDCC blade 315.

In FIG. 10E, as the wire is forced downward, the IDCC blade 315 cuts into the insulation 401 on the wire 400 to make electrical contact with the conductor portion 402 of the wire 400, without damaging the conductor 402.

There are other options for the assembly process. For example, a second embodiment of the assembly process includes a) a pin-to-housing insertion process; b) a housing assembly-to-PCB assembly process; and c) a wire-to-system assembly process. This second embodiment of the assembly process differ from the first embodiment in the order of the last two steps, that is, whether the wire is assembled before or after the housing assembly is assembled to the PCB. It will be understood that step (b) of the second embodiment is essentially the same as step (c) of the first embodiment, except that the assembled housing is not yet inserted into the PCB, and that step (c) of the second embodiment is essentially the same as step (b) of the first embodiment.

As will be appreciated by those of skill in the art, the IDCC connection system, including the IDCC header pin, housing and assemblies of the present invention, may be used in a wide variety of applications, including applications in which IDC connectors are conventionally used. For example, these connectors may be used in automotive applications.

Although the invention has been described with respect to specific embodiments, it will be appreciated that the invention is intended to cover all modifications and equivalents within the scope of the following claims.

LIST OF REFERENCE NUMERALS

100 Housing
200 Printed Circuit Board (PCB)
300 IDCC header pin
102 Housing Negative Space
105 Bottom Surface of Housing
110 Strain Relief of Housing
111 Twisting Strain Relief of Housing
112 Strain Relief Channel Lower Surface
113 First surface of Strain Relief
114 Second surface of Strain Relief
115 Strain Relief Overhang
116 Strain Relief Overhang Lower Surface
117 Housing upper side walls of Negative Space
118 Strain Relief Channel
119 Side Walls of Strain Relief Channel
120 Housing Stop Portion
121 Housing Lead-in Chamfer
122 Lower Side Walls of Negative Space
123 Housing Hole
130 Housing Retention Posts
131 Housing Retention Post Pedestal
132 Underside of Housing Retention Post Pedestal
133 First Protrusion Section of Housing Retention Post
134 Flat Sided Edge of Housing Retention Post Second Protrusion
135 Housing Retention Post Second Protrusion
136 Housing Retention Post Gap
140 Offset Overhangs of Twisting Strain Relief
141 Offset Channel Side Wall of Twisting Strain Relief
201 PCB Hole
202 PCB Hole Side Wall
300 IDCC Pin
301 Upper Section
302 Pin Barb Section
303 Lower Section
310 IDCC Flat
312 IDCC Blade Gap
313 First Surface of the Upper Section
314 Second Surface of the Upper Section
315 IDCC Blade
316 Side Walls of the Upper Section
317 Face of the Upper Section
318 IDCC Header Pin Forward Stop
319 First Pin Barb of IDCC Header Pin
320 Top Surface of First Pin Barb
321 Side Wall of First Pin Barb
322 Angled Side Wall of First Pin Barb
323 Second Pin Barb of IDCC Header Pin
324 Top Surface of Second Pin Barb
325 Side Wall of Second Pin Barb
326 Barb Lead-in Chamfer
327 Bottom Surface of Pin Barb Section
328 Sides of Pin Barb Section
329 Face Surface of Pin Barb Section
330 Compliant Retention Feature
331 Outer Edge of Compliant Hole
332 Inner Edge of Compliant Hole
333 Inner Beveled Wall of Compliant
334 Inner Hole of Compliant
335 Face of Lower Section
336 Oval Rounded Sides of Compliant
337 Side of Lower Section
338 Side of Lower Section
339 Side of Lower Section
340 IDCC Header Pin Tip
341 IDCC Header Pin Lead-in Chamfers
400 Wire
401 Wire Insulation
402 Wire Conductor

We claim:

1. A method for joining an Insulation Displacement Contact Compliant (IDCC) pin and housing, comprising the steps of:

aligning a lower section having a compliant retention feature of the IDCC pin with a negative space on the housing, and applying an insertion force to a flat surface on an end of the IDCC pin, wherein the lower section having the compliant retention feature of the IDCC pin first enters the negative space on the housing;

applying the insertion force to the flat surface of the IDCC pin so that a barb section of the IDCC pin engages the side walls of a lower portion of the negative space;

applying the insertion force further to the flat surface of the IDCC pin so that a forward stop of the Insulation Displacement Contact Compliant pin comes into contact with a housing stop portion; and joining a wire to the housing with an installed Insulation Displacement Contact Compliant (IDCC) pin, which comprises the steps of applying a downward force to the wire as it contacts a strain relief on the housing which centers the wire relative to opposite facing sides of a blade of the IDCC pin, and applying the downward force to the wire as it passes an overhang of the strain relief and maintains contact with the opposite facing sides of the blade.

2. The method for joining the Insulation Diplacement Contact Compliant (IDCC) and housing of claim 1, wherein the step of joining the wire to the housing with the installed Insulation Displacement Contact Compliant (IDCC) pin, comprises the step of:

positioning the wire over the IDCC pin in the housing before applying the downward force to the wire.

3. A method for joining an Insulation Displacement Contact Compliant (IDCC) pin and housing, comprising the steps of:

aligning a lower section having a compliant retention feature of the IDCC pin with a negative space on the housing, and applying an insertion force to a flat surface on an end of the IDCC pin, wherein the lower section having the compliant retention feature of the IDCC pin first enters the negative space on the housing;

applying the insertion force to the flat surface of the IDCC pin so that a barb section of the IDCC pin engages the side walls of a lower portion of the negative space;

applying the insertion force further to the flat surface of the IDCC pin so that a forward stop of the Insulation Displacement Contact Compliant pin comes into contact with a housing stop portion;

joining a printed circuit board to the housing with the Insulation Displacement Contact Compliant (IDCC) pin, wherein the step of joining the housing with the Insulation Displacement Contact Compliant (IDCC) pin to the printed circuit board, comprises the steps of:

aligning the IDCC pin to a hole in the printed circuit board, and applying a pressure to the ousing, and applying the pressure to the housing so that a lower portion of the IDCC pin, having the compliant retention feature of the IDCC pin entering the hole in the printed circuit board; and joining a wire to the housing with an installed Insulation Displacement Contact Compliant (IDCC) pin, having the compliant retention feature of the IDCC pin inside the hole in the printed circuit board, which comprises the steps of applying a downward force to the wire as it contacts a strain relief on the housing which centers the wire relative to sides of a blade of the IDCC pin, and applying the downward force to the wire as it passes an overhang of the strain relief and maintains contact with the blade.

4. The method for joining the housing with the installed Insulation Displacement Contact Compliant (IDCC) pin and with the printed circuit board of claim 3, wherein the step of joining the wire to the housing with the installed Insulation Displacement Contact Compliant (IDCC) pin and with the printed circuit board, comprises the step of:

positioning the wire over the IDCC pin in the housing before applying the downward force to the wire.

* * * * *